US011154109B2

(12) United States Patent
Li et al.

(10) Patent No.: US 11,154,109 B2
(45) Date of Patent: Oct. 26, 2021

(54) THREE-DIMENSIONAL (3D) SHOE BLANK MADE BY FLAT KNITTING MACHINE AND MANUFACTURING METHOD THEREOF

(71) Applicant: Wholeknit International Co., Ltd., Apia (WS)

(72) Inventors: Yu-Lin Li, Apia (WS); Yi-Hsing Dou, Apia (WS)

(73) Assignee: WHOLEKNIT INTERNATIONAL CO., LTD., Apia (WS)

( * ) Notice: Subject to any disclaimer, the term of this patent is extended or adjusted under 35 U.S.C. 154(b) by 90 days.

(21) Appl. No.: 15/849,421

(22) Filed: Dec. 20, 2017

(65) Prior Publication Data

US 2018/0343956 A1 Dec. 6, 2018

(30) Foreign Application Priority Data

Jun. 5, 2017 (TW) ..... 106118560

(51) Int. Cl.
*A43B 1/04* (2006.01)
*D04B 1/22* (2006.01)
(Continued)

(52) U.S. Cl.
CPC ..... *A43B 1/04* (2013.01); *A43B 1/14* (2013.01); *A43B 23/042* (2013.01); *D04B 1/108* (2013.01);
(Continued)

(58) Field of Classification Search
CPC ..... A43B 1/04; A43B 1/14; A43B 23/042; D04B 1/108; D04B 1/22; D04B 1/24; D04B 7/10; D04B 7/30; D10B 2403/0332
(Continued)

(56) References Cited

U.S. PATENT DOCUMENTS 2,628,438 A * 2/1953 Luchs ..... A43B 1/02 36/10
7,937,972 B2 * 5/2011 Busi ..... A41B 11/001 66/19
(Continued)

FOREIGN PATENT DOCUMENTS

CN 101583294 A 11/2009
CN 102271548 A 12/2011
(Continued)

*Primary Examiner* — Khoa D Huynh
*Assistant Examiner* — Uyen T Nguyen
(74) *Attorney, Agent, or Firm* — Innovation Capital Law Group, LLP; Vic Lin

(57) ABSTRACT

A 3D shoe blank is an integral knit fabric without any sewn portion made by a flat knitting machine and includes an upper portion knitted from at least a yarn, a front sole portion knitted from the upper portion with a folding line therebetween and two connection lines at two sides of the front sole portion and the upper portion, so the front sole portion is folded and connected to the upper portion to form a pocket structure, a rear portion knitted from the front sole portion, and a heel portion extending from a center rear end of the rear portion, two opposite sides of the heel portion respectively connected to a left rear end and a right rear end of the rear portion to form a 3D rear shoe portion with two joining lines between the heel portion and the rear portion on the two opposite sides.

12 Claims, 19 Drawing Sheets

(51) Int. Cl.
*A43B 23/04* (2006.01)
*A43B 1/14* (2006.01)
*D04B 1/10* (2006.01)

(52) U.S. Cl.
CPC ..... *D04B 1/22* (2013.01); *D10B 2403/0332* (2013.01); *D10B 2501/043* (2013.01)

(58) Field of Classification Search
USPC ..... 36/84; 66/185, 64, 70, 67, 76, 177, 186, 66/187
See application file for complete search history.

(56) References Cited

U.S. PATENT DOCUMENTS

| | | | | |
|---|---|---|---|---|
| 9,920,461 | B2 * | 3/2018 | Aristizabal | A43B 15/00 |
| 2008/0110048 | A1 * | 5/2008 | Dua | D04B 1/22 36/45 |
| 2010/0154256 | A1 | 6/2010 | Dua | |
| 2016/0213097 | A1 * | 7/2016 | Uchikawa | A43B 23/0245 |
| 2016/0219966 | A1 * | 8/2016 | Podhajny | D04B 1/108 |
| 2018/0184755 | A1 * | 7/2018 | Yumiba | A43B 9/02 |
| 2018/0199668 | A1 | 7/2018 | Yumiba et al. | |
| 2018/0303204 | A1 * | 10/2018 | Woodard | D04B 1/108 |
| 2018/0343954 | A1 | 12/2018 | Li et al. | |
| 2018/0343956 | A1 | 12/2018 | Li et al. | |
| 2018/0343974 | A1 * | 12/2018 | Hancock | A43B 23/07 |

FOREIGN PATENT DOCUMENTS

| | | | |
|---|---|---|---|
| JP | 2015014058 | A | 1/2015 |
| TW | 201633943 | A | 10/2016 |

* cited by examiner

THREE-DIMENSIONAL (3D) SHOE BLANK MADE BY FLAT KNITTING MACHINE AND MANUFACTURING METHOD THEREOF

PRIORITY

The present invention claims priority to the Application No. 106118560 filed on Jun. 5, 2017 in Taiwan (ROC), which was entitled "3D Shoe Blank Made by Flat Knitting Machine and Manufacturing Method Thereof". All of which are hereby incorporated by reference as if fully set forth herein.

FIELD OF INVENTION

This invention generally relates to a three-dimensional (3D) shoe blank and a manufacturing method thereof. Specifically, the present invention relates to a 3D integral knitted shoe blank made by a flat knitting machine and a manufacturing method thereof.

BACKGROUND

In the conventional shoe-making process, a shoe is made by connecting multiple pieces of shoe parts. Consequently, the materials and the processes for manufacturing the shoes become very complicated. In recent years, owing to better permeability and comfort, less consumables required, and lower cost in the manufacturing process compared to conventional shoes, knitted shoes have quickly developed and gradually occupied a place in the market.

Knitted shoes are generally made by knitting yarns to form a shoe blank using the knitting machine and further attaching the shoe blank to the shoe sole. Here, the shapes of the shoe blanks formed by knitting are varied with the various types of knitting machines and knitting methods. Limited by the number of needle beds and current methods of knitting, two-dimensional shoe blanks in a sheet fabric form are generally knitted and formed first, and the two-dimensional shoe blanks are further processed through seaming techniques to build a three-dimensional shape. However, due to the delicate and tedious seaming work required, it is hard to improve the production efficiency of the knitted shoes. In addition, two-dimensional shoe blanks usually only contain the part that covers the foot dorsal, resulting in lack of proper protection for the plantar, and such a two-dimensional shoe blank without the plantar part makes its conjugation and seaming with the shoe sole much more difficult.

SUMMARY OF THE INVENTION

In view of the prior art, it is an object of the invention to provide a 3D shoe blank made by using a flat knitting machine, wherein the 3D shoe blank is an integral knit fabric without any sewn portion, so the seaming work can be eliminated to greatly improve the production efficiency.

In an embodiment, the 3D shoe blank made by using a flat knitting machine includes an upper potion, a front sole portion, a rear portion, and a heel portion. The upper portion is knitted from at least a yarn. The front sole portion is formed by continuing knitting from the upper portion with a folding line formed between the front sole portion and the upper portion and two connection lines formed between two sides of the front sole portion and the upper portion respectively, so the front sole portion is folded and connected to the upper portion to form a pocket structure. The rear portion is formed by continuing knitting from the front sole portion. The heel portion extends from a center rear end of the rear portion. Two opposite sides of the heel portion are respectively connected to a left rear end and a right rear end of the rear portion, so the heel portion and the rear portion are combined to form a 3D rear shoe portion with two joining lines formed between the heel portion and the rear portion on the two opposite sides of the heel portion, respectively.

In an embodiment, the two connection lines extend outward and obliquely from the folding line toward an outer side of the 3D shoe blank.

In an embodiment, the upper portion substantially matches the front sole portion in shape and size.

In an embodiment, the 3D shoe blank further includes a first upper extension portion and a second upper extension portion connected respectively to two sides of a rear end of the upper portion, so the first upper extension portion, the second upper extension portion, and the upper portion are combined to form an upper assembly. The front sole portion is formed by continuing knitting from the upper portion and partially corresponds to the upper assembly.

In an embodiment, the 3D shoe blank further includes an extension strap partially connected to the heel portion and extending outward toward the two opposite sides of the heel portion.

In an embodiment, the 3D shoe blank further includes an extension portion connected between the heel portion and the extension strap, so the extension strap is partially connected to the heel portion by means of the extension portion.

In another embodiment, the invention provides a method for knitting a three-dimensional (3D) shoe blank (100) by using a flat knitting machine. The method includes: knitting at least a yarn to form an upper portion, wherein when knitting the upper portion, the knitting is gradually narrowed at two sides of the upper portion, and a plurality of live stitches are preserved on the needle bed at the two sides of the upper portion; continuing knitting and forming a front sole portion from the upper portion, wherein when the knitting of the front sole portion reaches two sides of the front sole portion, the live stitches preserved on the needle bed at the two sides of the upper portion are sequentially and respectively knitted with the two sides of the front sole portion, so the upper portion is folded and connected to the front sole portion to form a pocket structure; continuing knitting and forming a rear portion from the front sole portion, wherein when forming the rear portion, a plurality of live stitches are preserved on the needle bed at two sides of a rear end of the rear portion; and continuing knitting to form a heel portion with a predetermined number of stitches from a center of the rear end of the rear portion, wherein when the knitting of the heel portion reaches the predetermined number of stitches at two opposite sides of the heel portion, the live stitches preserved at the two sides of the rear end of the rear portion are sequentially and respectively knitted with the two opposite sides of the heel portion, so the heel portion and the rear portion are combined to form a 3D rear shoe portion.

In an embodiment, before forming the upper portion, the method further includes: knitting the at least a yarn to form a first upper extension portion, wherein when knitting the first upper extension portion, the stitches are gradually decreased at an outer side and increased at an inner side of the first upper extension portion up to where the upper portion is to be formed, and a plurality of live stitches are preserved on the needle bed at the outer side of the first upper extension portion; knitting at least another yarn to form a second upper extension portion, wherein when knitting the second upper extension portion, the stitches are gradually decreased at an outer side and increased at an inner side of the second upper extension portion up to where the upper portion is to be formed, and a plurality of live stitches are preserved on the needle bed at the outer side of the second upper extension portion, and wherein the first upper extension portion and the second upper extension portion are spaced apart and substantially symmetric and together with the upper portion to form an upper assembly.

In an embodiment, the rear portion is knitted from the yarn of the front sole portion or another yarn, or the rear portion is knitted from the yarn of the front sole portion together with another yarn.

In an embodiment, the heel portion is knitted from the yarn of the rear portion or another yarn, or the heel portion is knitted from the yarn of the rear portion together with another yarn.

In an embodiment, the method further includes: after the 3D rear shoe portion is formed, knitting and forming an extension strap, wherein the extension strap is partially connected to the heel portion and extends outward toward the two opposite sides of the heel portion.

In an embodiment, the method further includes: knitting from the heel portion to form an extension portion connected between the heel portion and the extension strap, so the extension strap is partially connected to the heel portion by means of the extension portion.

Compared to the prior art, the 3D shoe blank of the invention is an integral knit fabric without any sewn portion made by a flat knitting machine, so the seaming work can be omitted to simplify the manufacturing process. The method of the invention utilizes an innovative knitting design to form an integral knit fabric not limited to the number of needle beds of the knitting machine, so the equipment cost can be effectively reduced and the production efficiency can be improved.

DETAILED DESCRIPTION OF THE PRESENT INVENTION

Figure 1:
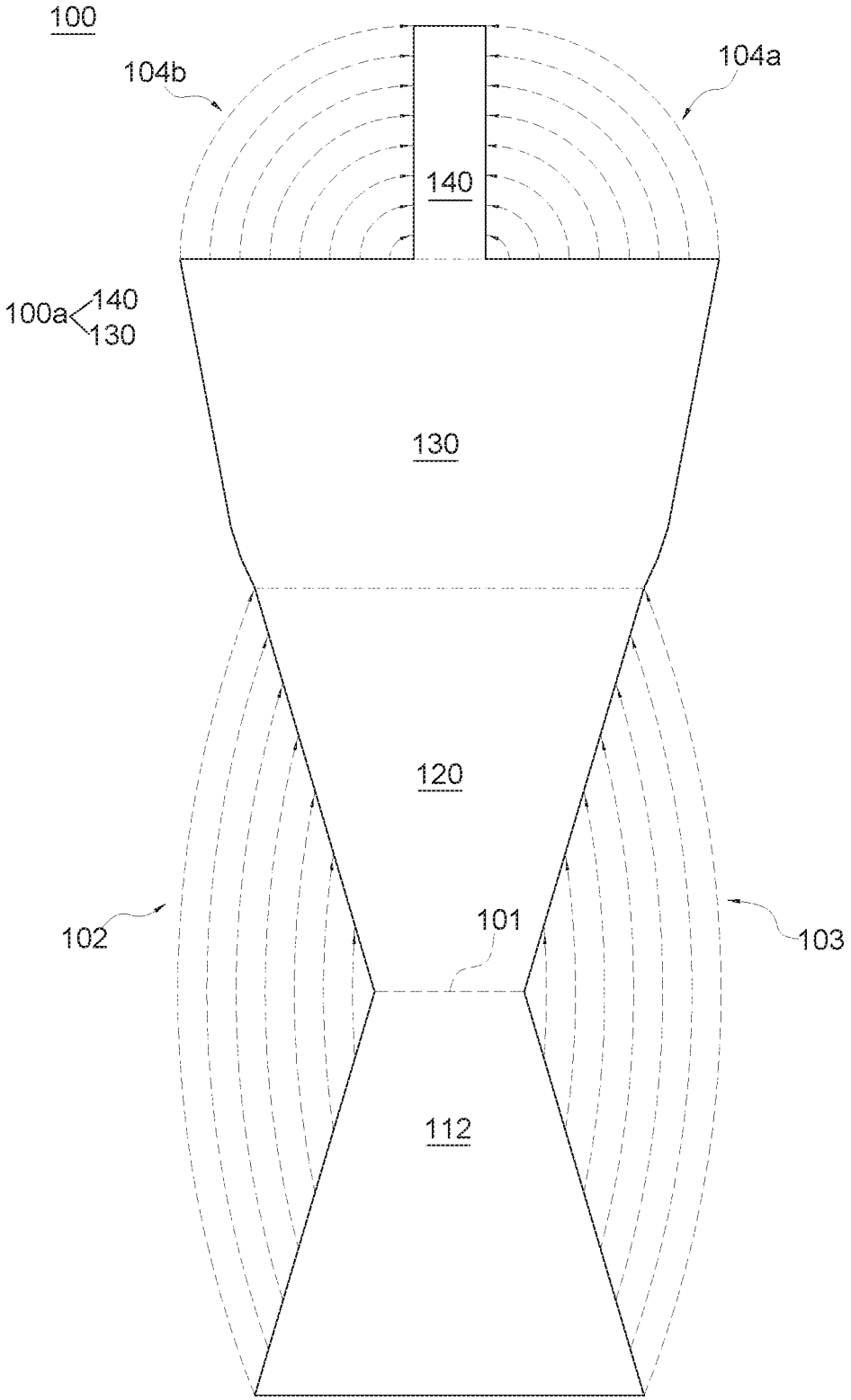
FIG. 1 is a schematic plan view of a first embodiment of the three-dimensional (3D) shoe blank.
Figure 2:
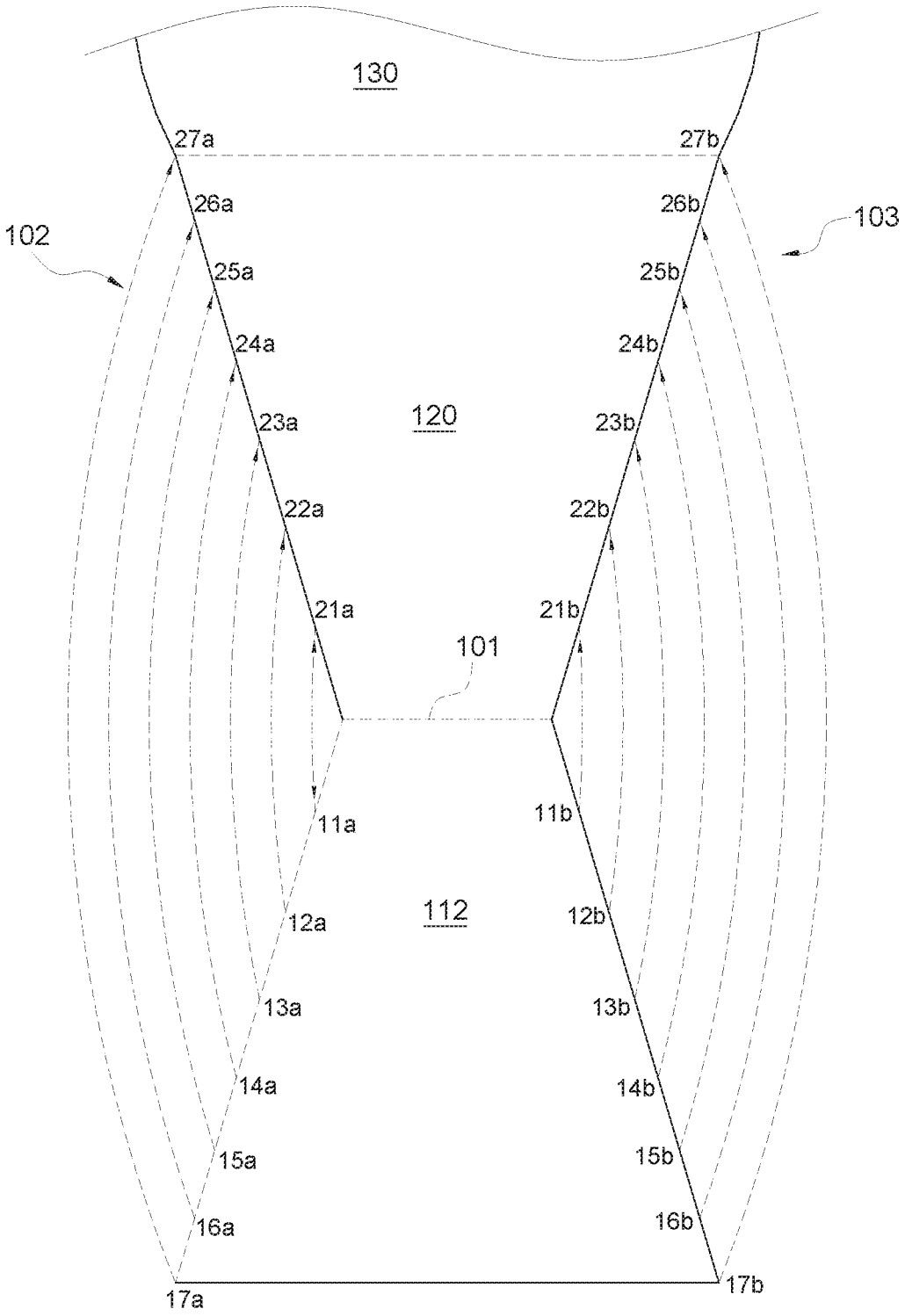
FIG. 2 is a schematic plan view of an upper portion and a front sole portion of the 3D shoe blank of FIG. 1.
Figure 3:
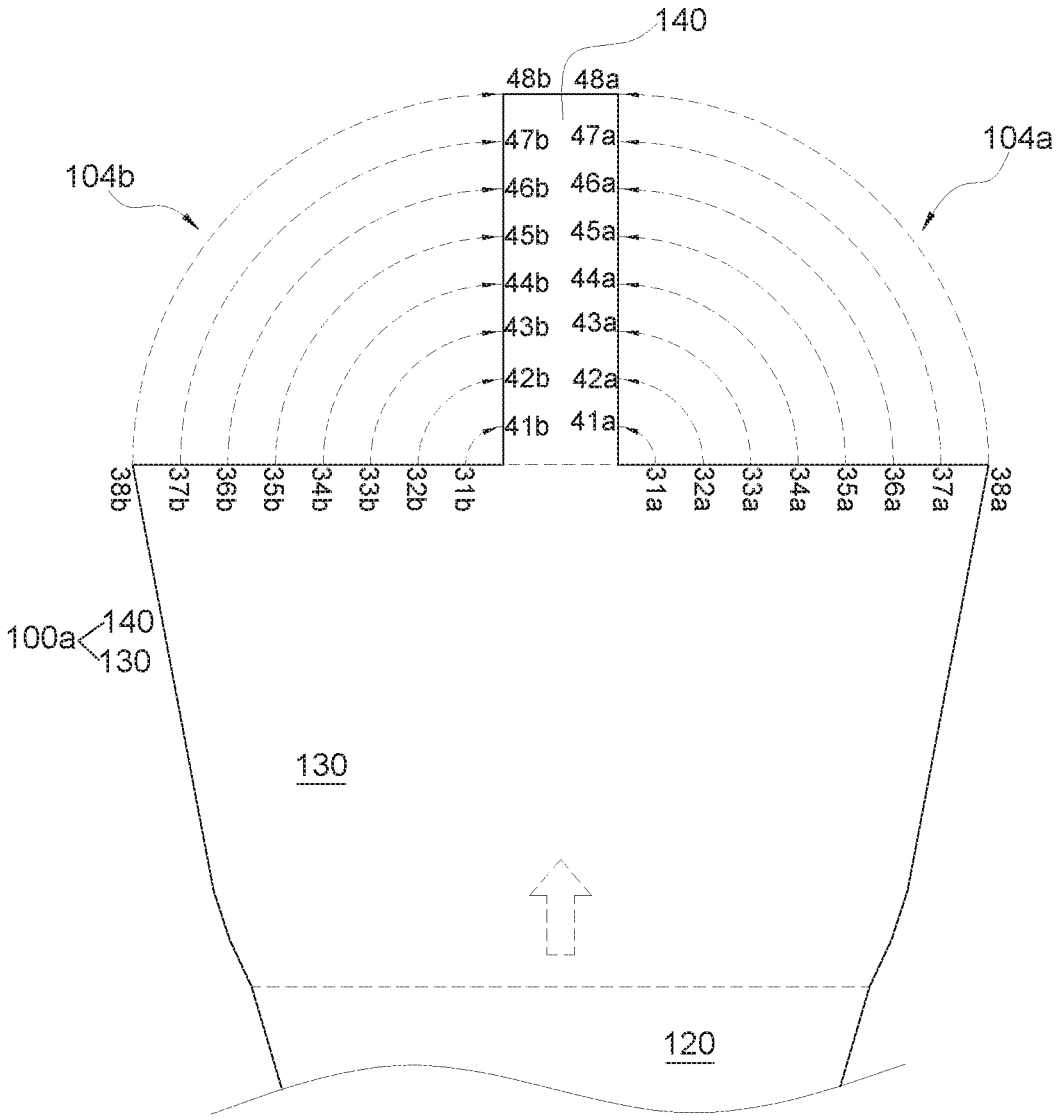
FIG. 3 is a schematic plan view of a rear portion and a heel portion of the 3D shoe blank of FIG. 1.
Figure 4:
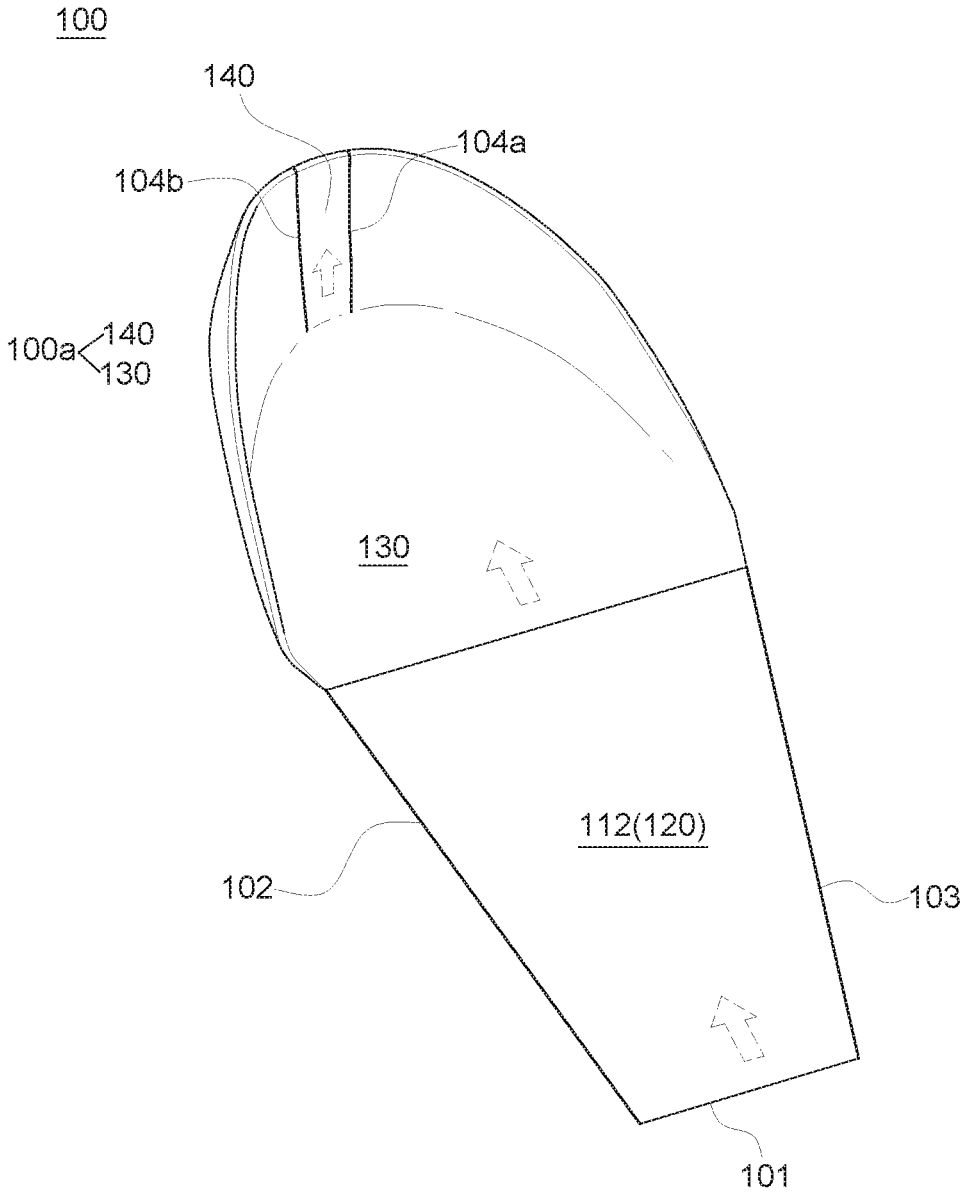
FIG. 4 is a 3D schematic view of the first embodiment of the 3D shoe blank.

For a thorough understanding of the invention, details of steps and structures of the invention will be described. Any manufacturing processes and specific steps of the knitting technique that are well known in the art will not be described in order not to impose undue limitations to the invention.

A three-dimensional (3D) shoe blank of the invention is an integral knit fabric without any sewn portion and made by using a flat knitting machine. For example, the 3D shoe blank can be knitted by using a double-bed flat knitting machine, not limited thereto. As shown in FIG. 1 to FIG. 4, in a first embodiment, the 3D shoe blank 100 includes an upper portion 112, a front sole portion 120, a rear portion 130, and a heel portion 140. The upper portion 112 is preferably double-knitted from at least a yarn to have two technical surfaces, but limited thereto. That is, the outer surface of the upper portion 112 that faces outward and the inner surface of the upper portion 112 that faces the front sole portion 120 are both technical surfaces. In other embodiments, according to practical applications, the upper portion 112 can be single-knitted to have a single technical surface. Further, at least one yarn stated herein is preferably formed by twisting and combining multiple yarns with different characteristic (such as materials, types, shapes, colors and so on), but it is not limited thereto.

The front sole portion 120 is formed by continuing knitting from the upper portion 112 with a folding line 101 formed between the front sole portion 120 and the upper portion 112 and two connection lines 102 and 103 formed between the two sides of the front sole portion 120 and the upper portion 112 respectively, so the front sole portion 120 is folded and connected to the upper portion 112 to form a pocket structure. That is, the front sole portion 120 is formed by continuing knitting from one side of the upper portion, while folding toward the direction of the front sole portion 120, so a virtual folding line 101 can be formed between the upper portion 112 and the front sole portion 120. In this embodiment, the front sole portion 120 completely corresponds to the upper portion 112. In other words, the upper portion 112 substantially matches the front sole portion 120 in shape and size. In an embodiment, the front sole portion 120 is preferably formed by continuing knitting from the yarn of the upper portion, but not limited thereto. According to design needs, the front sole portion 120 can be double-knitted or single-knitted by using other yarns having the same attribute or amount as the upper portion 112.

When the upper portion 112 and the front sole portion 120 are folded to form the pocket structure, the front sole portion 120 and the upper portion 112 are connected at two sides by the connection lines 102 and 103. For example, the front sole portion 120 is formed by continuing knitting from the front end of the upper portion 112, so the virtual folding line 101 is formed between the front ends of the upper portion 112 and the front sole portion 120. The two connection lines 102 and 103 extend outward and obliquely from two ends of the virtual folding line 101 toward an outer side of the rear portion 130. For example, the connection line 102 extends rearward from the left end of the folding line 101 to connect the left side edge of the upper portion 112 and the left side edge of the front sole portion 120. The connection line 103 extends rearward from the right end of the folding line 101 to connect the right side edge of the upper portion 112 and the right side edge of the front sole portion 120. As such, the upper portion 112 and the front sole portion 120 are folded toward each other and connected to form the pocket structure.

The rear portion 130 is connected to the front sole portion 120. In an embodiment, the rear portion 130 is preferably formed by continuing knitting from a rear end of the front sole portion 120. In an embodiment, the rear portion 130 is preferably knitted from at least a yarn by double-knitting. In an embodiment, the rear portion 130 can be knitted from the yarns previously used or another yarn that is additionally introduced. In another embodiment, the rear portion 130 can be knitted from the yarns previously used together with another yarn. For example, the rear portion 130 can be knitted by continuing using the yarn of the upper portion 112, the yarn of the front sole portion 120, the yarns of the upper portion 112 and the front sole portion 120, or another yarn. Alternatively, the rear portion 130 can be knitted by using another yarn together with the yarn of the upper portion 112, the yarn of the front sole portion 120, or the yarns of the upper portion 112 and the front sole portion 120.

The heel portion 140 extends from a center rear end of the rear portion 130. Two opposite sides of the heel portion 140 are respectively connected to a left rear end and a right rear end of the rear portion 130, so the heel portion 140 and the rear portion 130 are combined to form a 3D rear shoe portion 100*a*, and two joining lines 104*a* and 104*b* are formed between the heel portion 140 and the rear portion 130 at the two opposite sides of the heel portion 140, respectively. In an embodiment, the heel portion 140 can be knitted from the yarns previously used or another yarn that is additionally introduced. In another embodiment, the heel portion 140 can be knitted from the yarns previously used together with another yarn. In an embodiment. The heel portion 140 is preferably knitted by continuing using the yarn of the rear portion 130 by double-knitting. Alternatively, the heel portion 140 is knitted by continuing using the yarn of the rear portion 130 together with another yarn.

Figure 5:
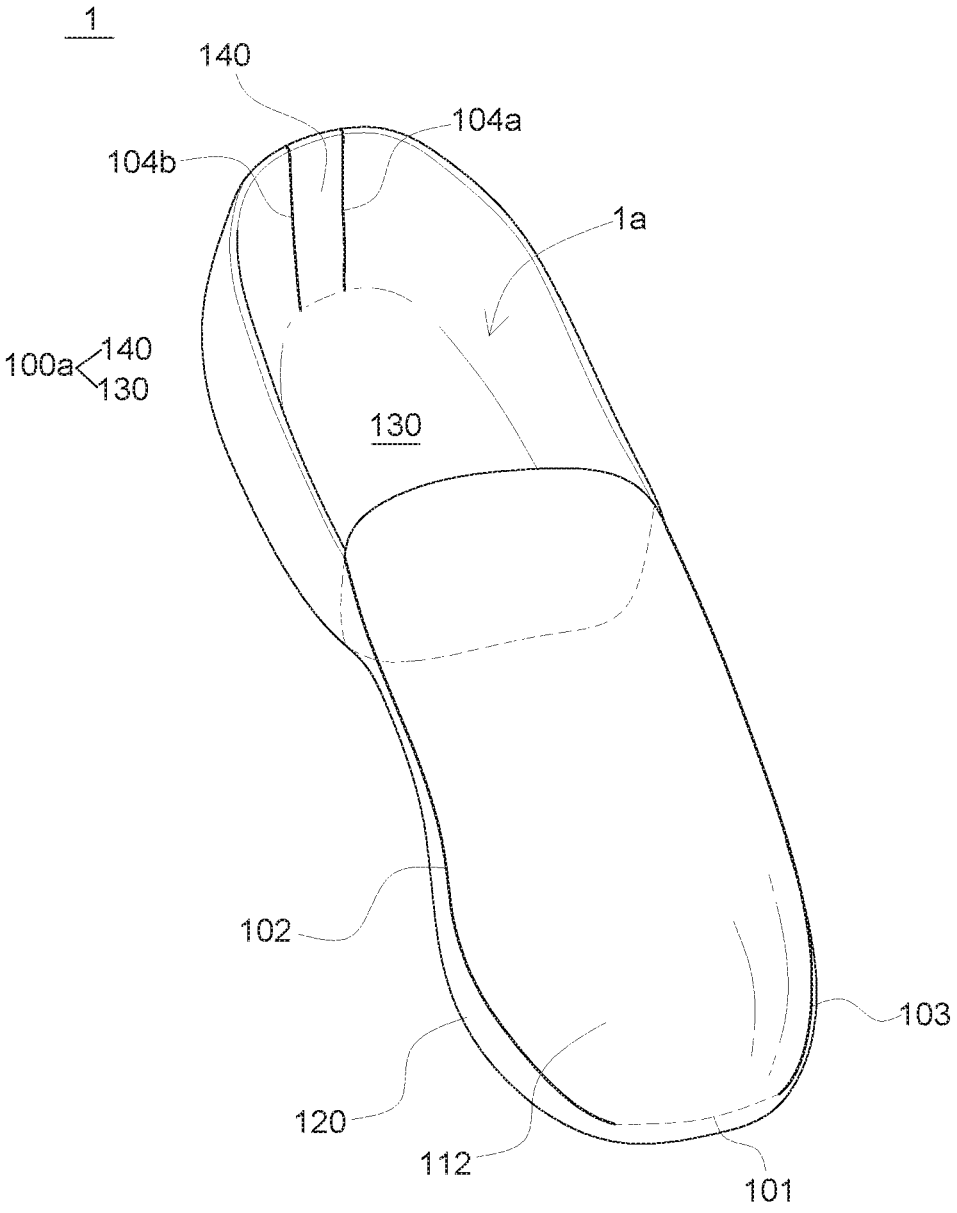
FIG. 5 is a 3D schematic view of a shoe body after the 3D shoe blank of FIG. 4 is molded.

As shown in FIG. 5, after the knitting of the 3D shoe blank 100 is finished, without any seaming work, the 3D shoe bank 100 can be worn on the last and molded to form a shoe body 1. For example, when the 3D shoe blank 100 is knitted, a thermoplastic yarn can be knitted simultaneously. When the 3D shoe blank 100 is processed to form the shoe body 1, since the thermoplastic yarn is thermal-curable, by thermal molding, the thermoplastic yarn can be melted to be uniformly distributed over the shoe body 1 and then hardened to support the shape of the shoe body 1. The material of the thermoplastic yarn can be any suitable thermal curable material including, but not limited to, nylon, polyester, acrylic, etc. It is noted that the shoe body 1 can be shaped by other methods, not limited to the use of thermoplastic yarn during the knitting process.

After the 3D shoe blank 100 is molded into the shoe body 1, the upper portion 112 and the front sole portion 120 can cover from the foot dorsal to the front plantar, while the 3D rear shoe portion 100*a* constituted by the rear portion 130 and the heel portion 140 covers the lateral portion, the rear plantar, and the heel of the foot. Specifically, the rear edge of the upper portion 112 (i.e. the cast-on line of the 3D shoe blank 100) and the upper edge of the 3D rear shoe portion 100*a* (i.e. the outer edges of the rear portion 130 and the heel portion 140) together define a shoe opening 1*a* of the shoe body 1 to allow the foot to enter the interior space enclosed by the shoe body 1. The connection lines 102 and 103 on two opposite sides of the front sole portion 120 connecting the upper portion 112 respectively start from two ends of the folding line 101 and extend gradually outward and obliquely toward the 3D rear shoe portion 100*a* until reaching the shoe opening 1*a*, so the front sole portion 120 preferably covers from the front plantar toward two opposite front lateral portions. For example, the upper portion 112 can cover the dorsal surface of the front foot, and the front sole portion 120 covers the front plantar and extends upward to cover the front lateral portions. Moreover, a portion of the rear portion 130 covers the rear plantar while another portion of the rear portion 130 extends upward to cover the rear lateral portions and extends rearward to cover the heel with the heel portion 140. Therefore, the shoe body 1 formed from the 3D shoe blank 100 of the invention can substantially cover the dorsal, the plantar, the lateral sides, and the heel of the foot.

In the first embodiment, although the 3D shoe blank 100 is illustrated with completely overlapped upper portion 112 and front sole portion 120, but not limited thereto. In other embodiments, by changing the upper design, the 3D shoe blank may have a different outer appearance. As shown in FIG. 6 to FIG. 10, in a second embodiment, a shoe blank 200 includes an upper portion 212, a front sole portion 220, a rear portion 130, and a heel portion 140 and further includes a first upper extension portion 214*a*, a second upper extension portion 214*b*. Similarly, the upper portion 212 is knitted from at least a yarn. The front sole portion 220 is formed by continuing knitting from a virtual folding line 201, and two opposite sides of the upper portion 212 and the front sole portion 220 are connected by two connection lines 202 and 203. As such, the front sole portion 220 and the upper portion 212 are connected to form a pocket structure. The rear portion 130 is formed by continuing knitting from the front sole portion 220. The heel portion 140 extends from a center rear end of the rear portion 130. The two opposite sides of the heel portion 140 are respectively connected to a left rear end and a right rear end of the rear portion 130, so the heel portion 140 and the rear portion 130 are combined to form a 3D rear shoe portion 100*a*, and two joining lines 104*a* and 104*b* are formed between the heel portion 140 and the rear portion 130 on the two opposite sides of the heel portion 140, respectively. In this embodiment, details of the upper portion 212, the front sole portion 220, the rear portion 130, and the heel portion 140 can be found in the related descriptions of the embodiment in FIG. 1 and will not be elaborated again. Hereafter, the details of the first upper extension portion 214*a* and the second upper extension portion 214*b* are illustrated.

Specifically, the first upper extension portion 214*a* and the second upper extension portion 214*b* are spaced apart and connected to two sides of the rear end of the upper portion 212 (such as left rear end and right rear end), so that the first upper extension portion 214*a*, the second upper extension portion 214*b*, and the upper portion 212 are combined to form an upper assembly 210. In an embodiment, the upper extension portions 214*a* and 214*b* are preferably knitted from two yarns of the same attribute or amount by double-knitting. The upper portion 212 is preferably double-knitted by using the yarn of the first upper extension portion 214*a* or the yarn of the second upper extension portion 214*b*, but not limited thereto. In another embodiment, the upper portion 212 can bed knitted from another yarn having the same attribute or amount as the upper extension portions 214*a* and 214*b*. Moreover, the upper extension portions 214*a* and 214*b* are preferably symmetric in shape (i.e. the outer appearances thereof are substantially visually symmetric), but not limited thereto.

The front sole portion 220 is formed by continuing knitting from one side of the upper portion 212 that is opposite to the upper extension portions 214*a* and 214*b*. The upper portion 212 together with the upper extension portions 214*a* and 214*b* are folded toward the front sole portion 220; the virtual folding line 201 is formed between the upper portion 212 and the front sole portion 220. In this embodiment, the front sole portion 220 partially matches the upper assembly 210 that is constituted by the upper portion 212 and the upper extension portions 214*a* and 214*b* overlap and cover the front sole portion 220, a portion of the front sole portion 220 is not covered by the upper assembly 210 and exposed between the upper extension portions 214*a* and 214*b*. In an embodiment, the front sole portion 220 is preferably double-knitted by using the yarn of the upper portion 212, but not limited thereto. According to design needs, the front sole portion 220 can be single-knitted or double-knitted by using other yarns having the same attribute or amount as the upper portion 212.

The front sole portion 220 is formed by continuing knitting from the upper portion 212 at the location of the folding line 201. Two opposite sides of the front sole portion 220 are connected to the two sides of the upper portion 212 and the outer edges of the upper extension portions 214*a* and 214*b* by the two connection lines 202 and 203. For example, the connection line 202 extends rearward from the left end of the folding line 201 to connect the left side edge of the upper portion 212 and the left side edge of a front section of the front sole portion 220 and further to connect the left side edge of the first upper extension portion 214*a* and the left side edge of a rear section of the front sole portion 220. The connection line 203 extends rearward from the right end of the folding line 201 to connect the right side edge of the upper portion 212 and the right side edge of the front section of the front sole portion 220 and further to connect the right side edge of the second upper extension portion 214*b* and the right side edge of the rear section of the front sole portion 220. As such, the upper assembly 210 and the front sole portion 220 are folded and connected at two opposite sides to form the pocket structure.

Figure 10:
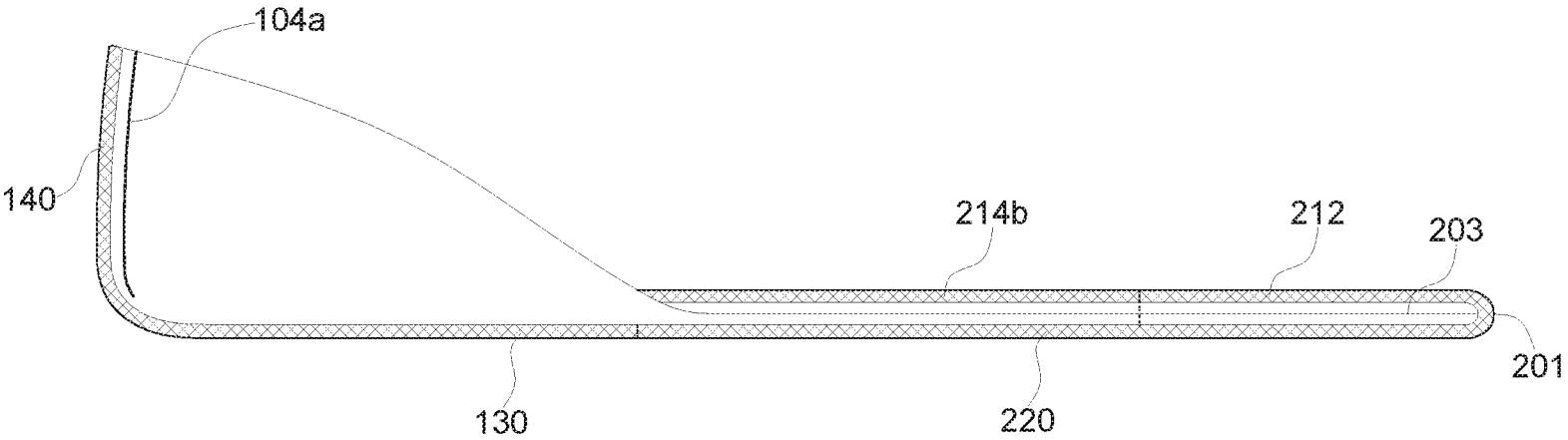
FIG. 10 is a schematic cross-sectional view of the 3D shoe blank of FIG. 9.

It is noted that the thickness of the 3D shoe blank 200 in FIG. 10 is exaggeratedly emphasized for better understanding. In practical applications, the thickness of the 3D shoe blank 200 varies with the choice of the yarns, the knitting density, etc.

Figure 11:
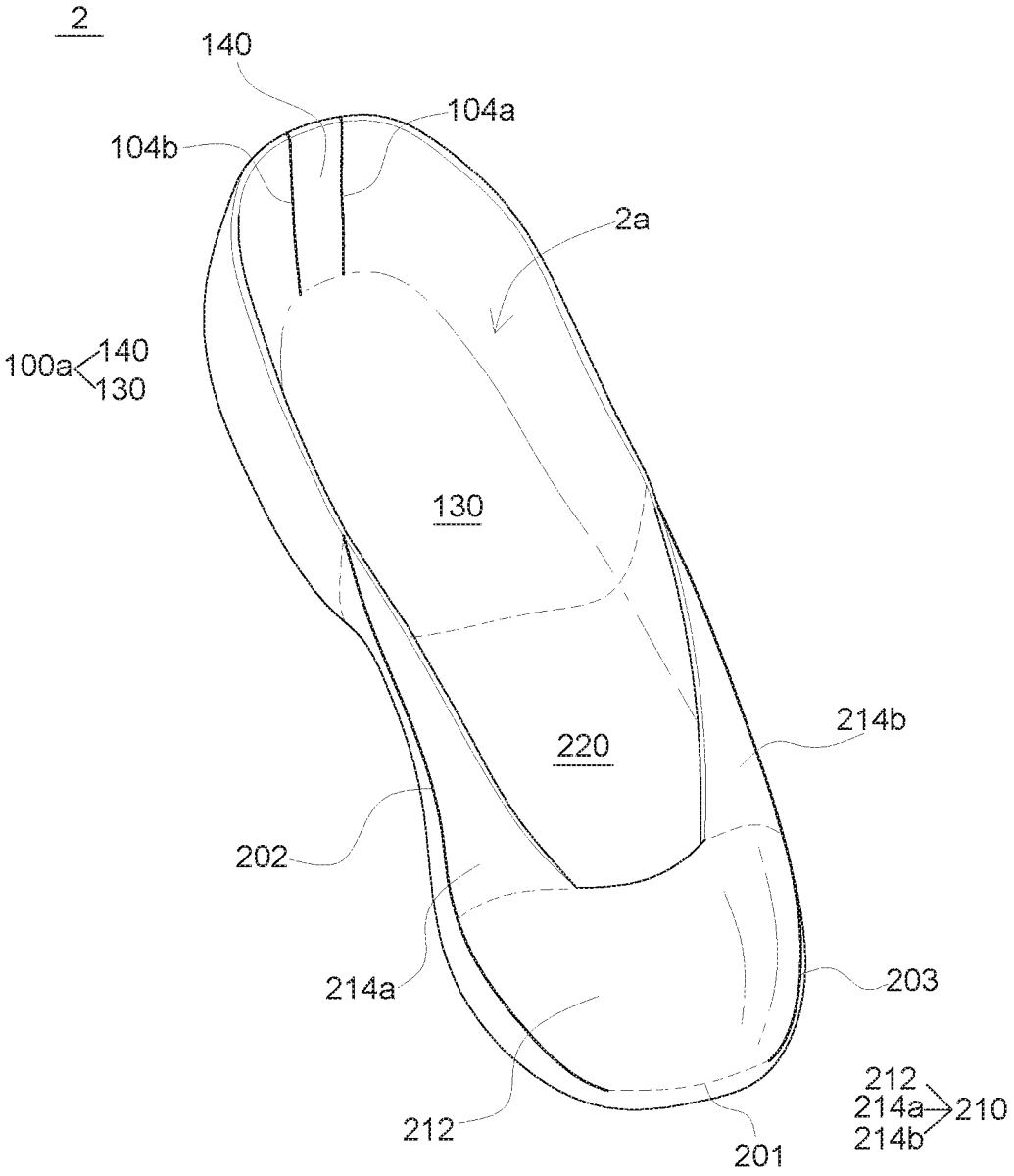
FIG. 11 is a 3D schematic view of a shoe body after the 3D shoe blank of FIG. 9 is molded.

As shown in FIG. 11, after the knitting of the 3D shoe blank 200 is finished, without any seaming work, the 3D shoe bank 200 can be worn on the last and molded to form a shoe body 2. After the 3D shoe blank 200 is molded into the shoe body 2, the upper assembly 210 and the front sole portion 220 can cover from the foot dorsal to the front plantar, while the 3D rear shoe portion 100*a* constituted by the rear portion 130 and the heel portion 140 covers the rear lateral portions, the rear plantar and the heel of the foot. Specifically, the inner edges of the upper portion 212 and the upper extension portions 214*a*, 214*b* and the upper edge of the 3D rear shoe portion 100*a* (i.e. the outer edges of the rear portion 130 and the heel portion 140) together define a shoe opening 2*a* of the shoe body 2 to allow the foot to enter the interior space enclosed by the shoe body 2. The connection lines 202 and 203 respectively start from two ends of the folding line 201 and extend gradually outward and obliquely toward the 3D rear shoe portion 100*a* until reaching the shoe opening 2*a*, so the front sole portion 220 preferably covers from the front plantar toward two opposite front lateral portions. For example, the upper portion 212 and the upper extension portions 214*a* and 214*b* can cover the dorsal surface of the front foot, and a portion of the front sole portion 220 covers the front plantar, while at least another portion of the front sole portion 220 extends upward to cover the front lateral portions. Moreover, a portion of the rear portion 130 covers the rear plantar, while another portion of the rear portion 130 extends upward to cover the rear lateral portions and extends rearward to cover the heel with the heel portion 140. Therefore, the shoe body 2 formed from the 3D shoe blank 200 of the invention can substantially cover the dorsal, the plantar, the lateral sides, and the heel of the foot.

In an embodiment, the method for knitting the 3D shoe blank by using a flat knitting machine includes: knitting at least a yarn to form an upper portion (such as 112, 212), wherein when knitting the upper portion, the knitting is gradually narrowed at two sides of the upper portion, and a plurality of live stitches (such as 11*a*~17*a*, 11*b*~17*b* in FIG. 2, 11*a*~13*a*, 11*b*~13*b* in FIG. 7) are preserved on the needle bed at the two sides of the upper portion; continuing knitting and forming a front sole portion (such as 120, 220) from the upper portion, wherein when the knitting of the front sole portion reaches two sides of the front sole portion, the live stitches preserved on the needle bed at the two sides of the upper portion are sequentially and respectively knitted with the two sides of the front sole portion, so the upper portion is folded and connected to the front sole portion to form a pocket structure; continuing knitting and forming a rear portion from the front sole portion (such as 130), wherein when forming the rear portion, a plurality of live stitches (31*a*~38*a*, 31*b*~38*b* in FIG. 3 and FIG. 8) are preserved on the needle bed at two sides of a rear end of the rear portion; and continuing knitting to form a heel portion (such as 140) with a predetermined number of stitches from a center of the rear end of the rear portion, wherein when the knitting of the heel portion reaches the predetermined number of stitches at two opposite sides of the heel portion, the live stitches preserved at the two sides of the rear end of the rear portion are sequentially and respectively knitted with the two opposite sides of the heel portion, so the heel portion and the rear portion are combined to form a 3D rear shoe portion (such as 100*a*).

Figure 6:
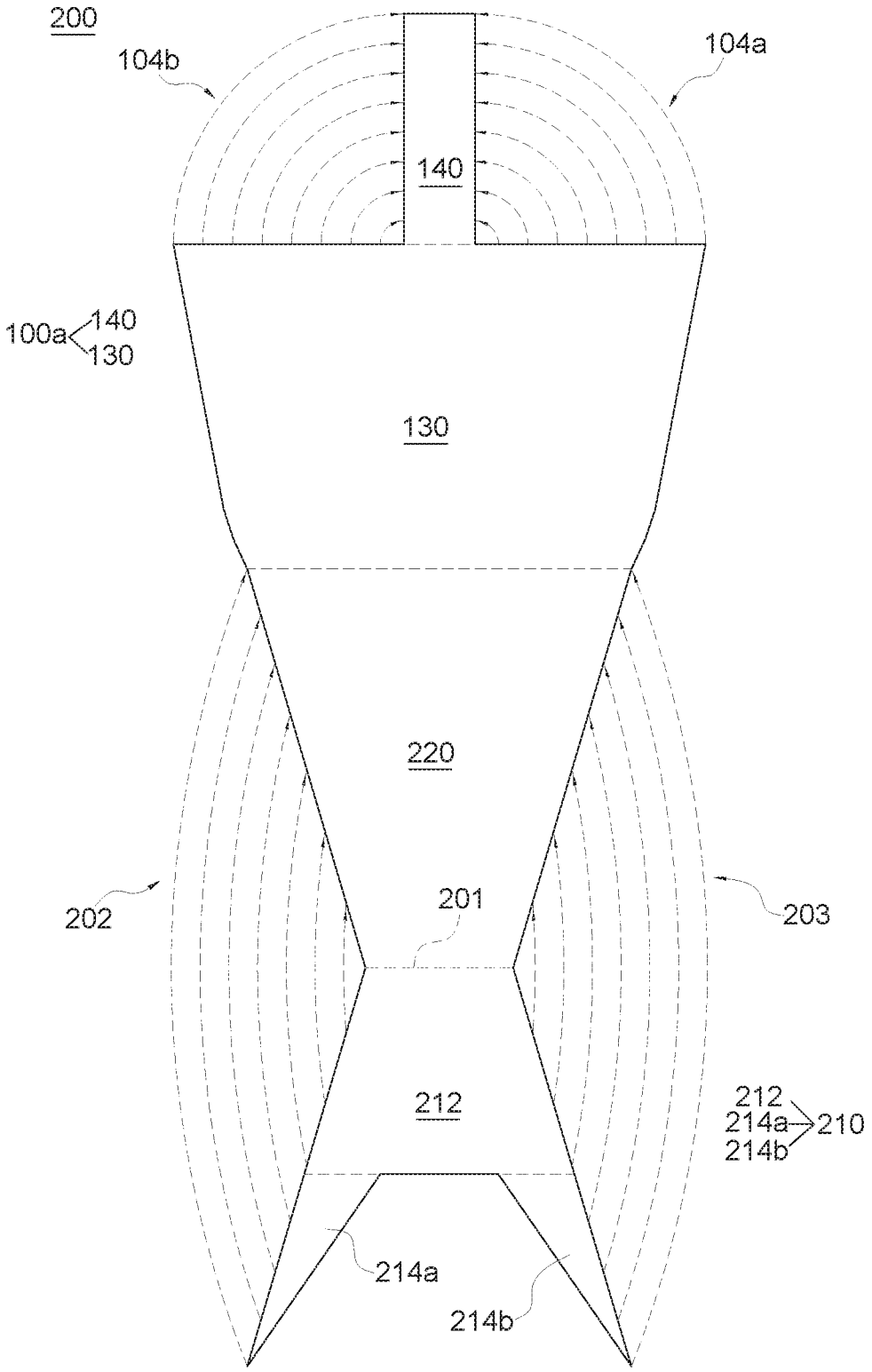
FIG. 6 is a schematic plan view of a second embodiment of the 3D shoe blank.
Figure 7:
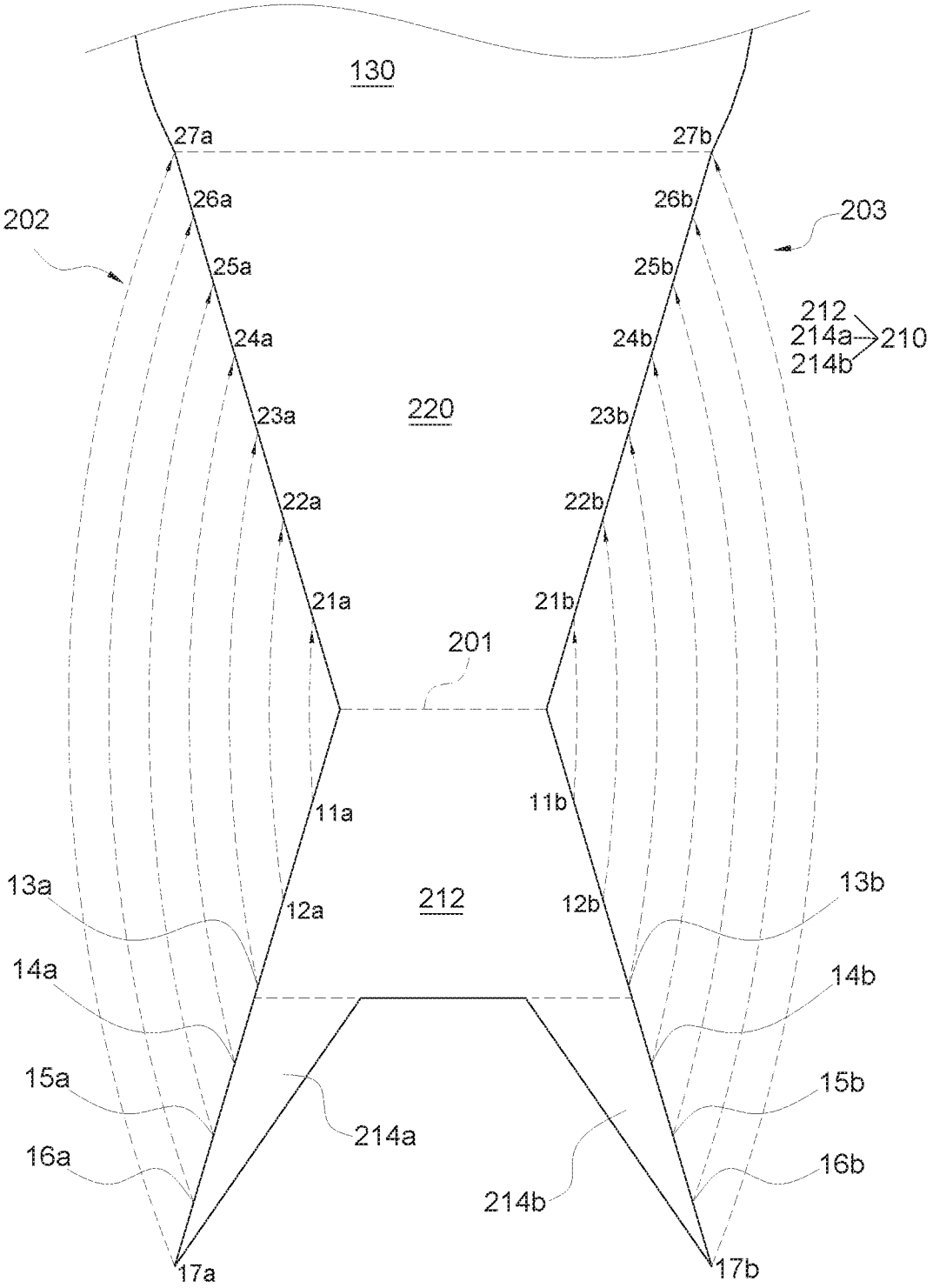
FIG. 7 is a schematic plan view of an upper assembly and a front sole portion of the 3D shoe blank of FIG. 6.
Figure 8:
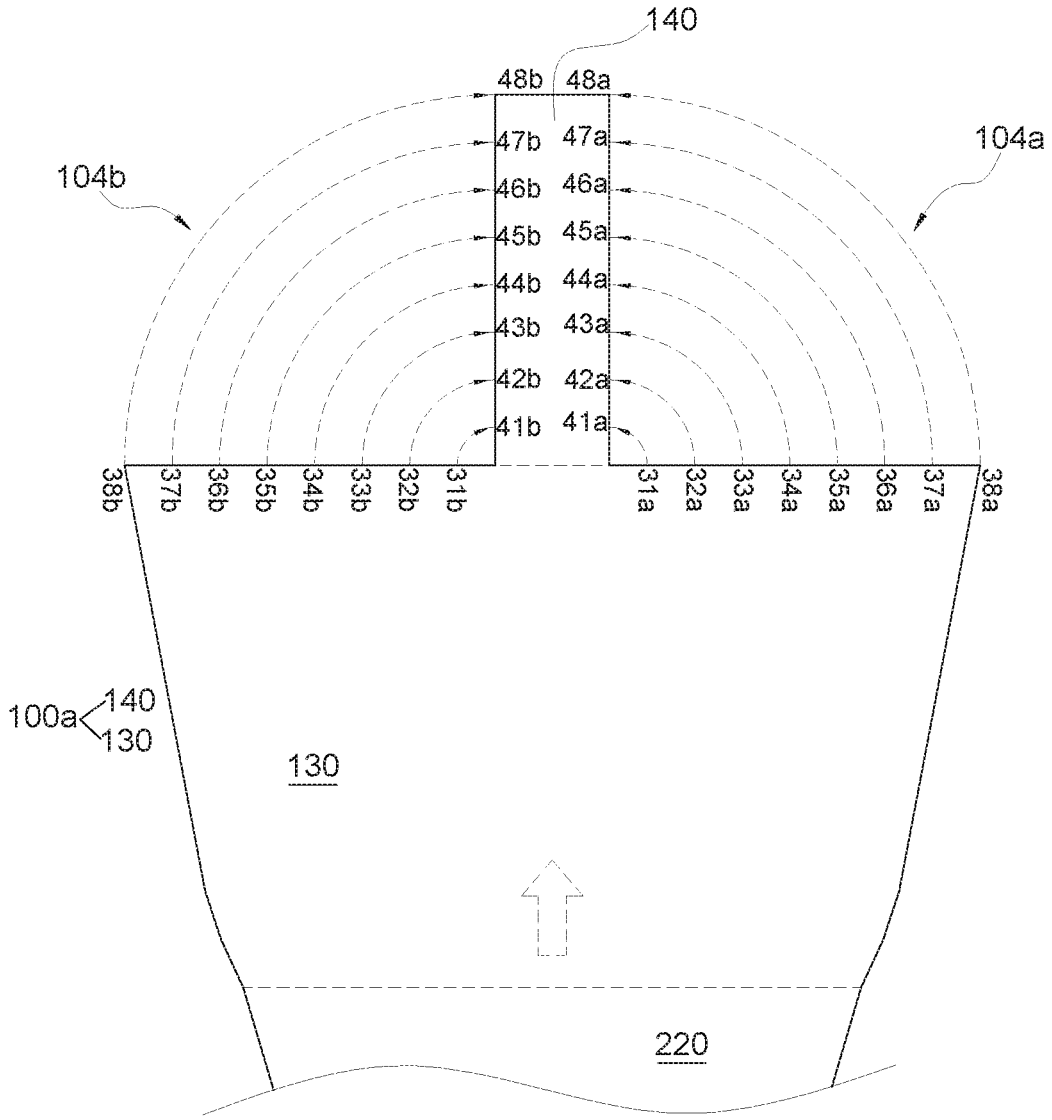
FIG. 8 is a schematic plan view of a rear portion and a heel portion of the 3D shoe blank of FIG. 7.
Figure 9:
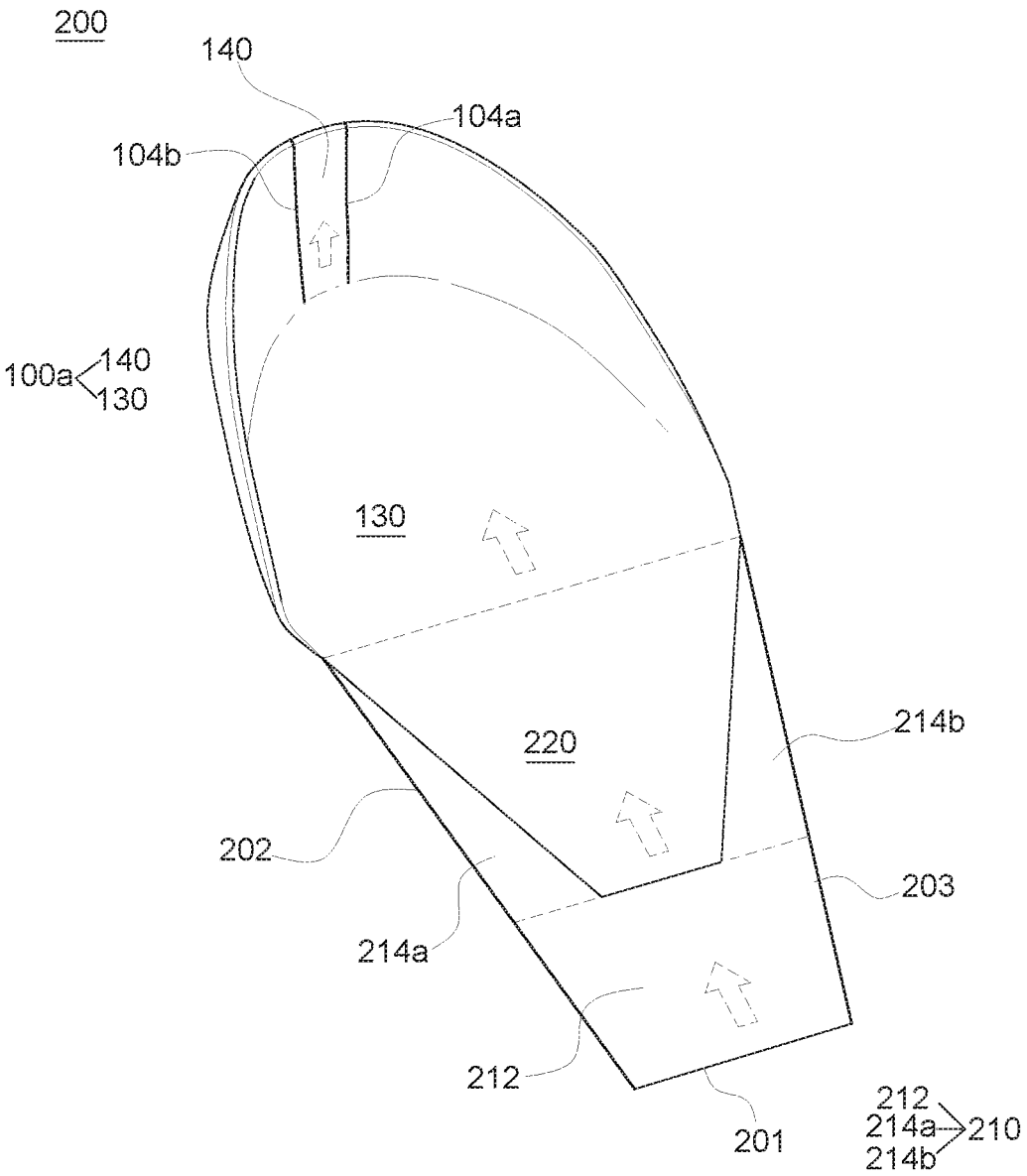
FIG. 9 is a 3D schematic view of the second embodiment of the 3D shoe blank.

When forming the 3D shoe blank 200 of FIG. 6, before forming the upper portion 212, the method further includes: knitting the at least a yarn to form a first upper extension portion (such as 214*a*), wherein when knitting the first upper extension portion, the stitches are gradually decreased at an outer side and increased at an inner side of the first upper extension portion up to where the upper portion is to be formed, and a plurality of live stitches (such as 14*a*~17*a*) are preserved on the needle bed at the outer side of the first upper extension portion; and knitting at least another yarn to form a second upper extension portion (such as 214*b*), wherein when knitting the second upper extension portion, the stitches are gradually decreased at an outer side and increased at an inner side of the second upper extension portion up to where the upper portion is to be formed, and a plurality of live stitches (such as 14*b*~17*b*) are preserved on the needle bed at the outer side of the second upper extension portion, and wherein the first upper extension portion and the second upper extension portion are spaced apart and substantially symmetric and together with the upper portion form an upper assembly (such as 210).

Figure 12:
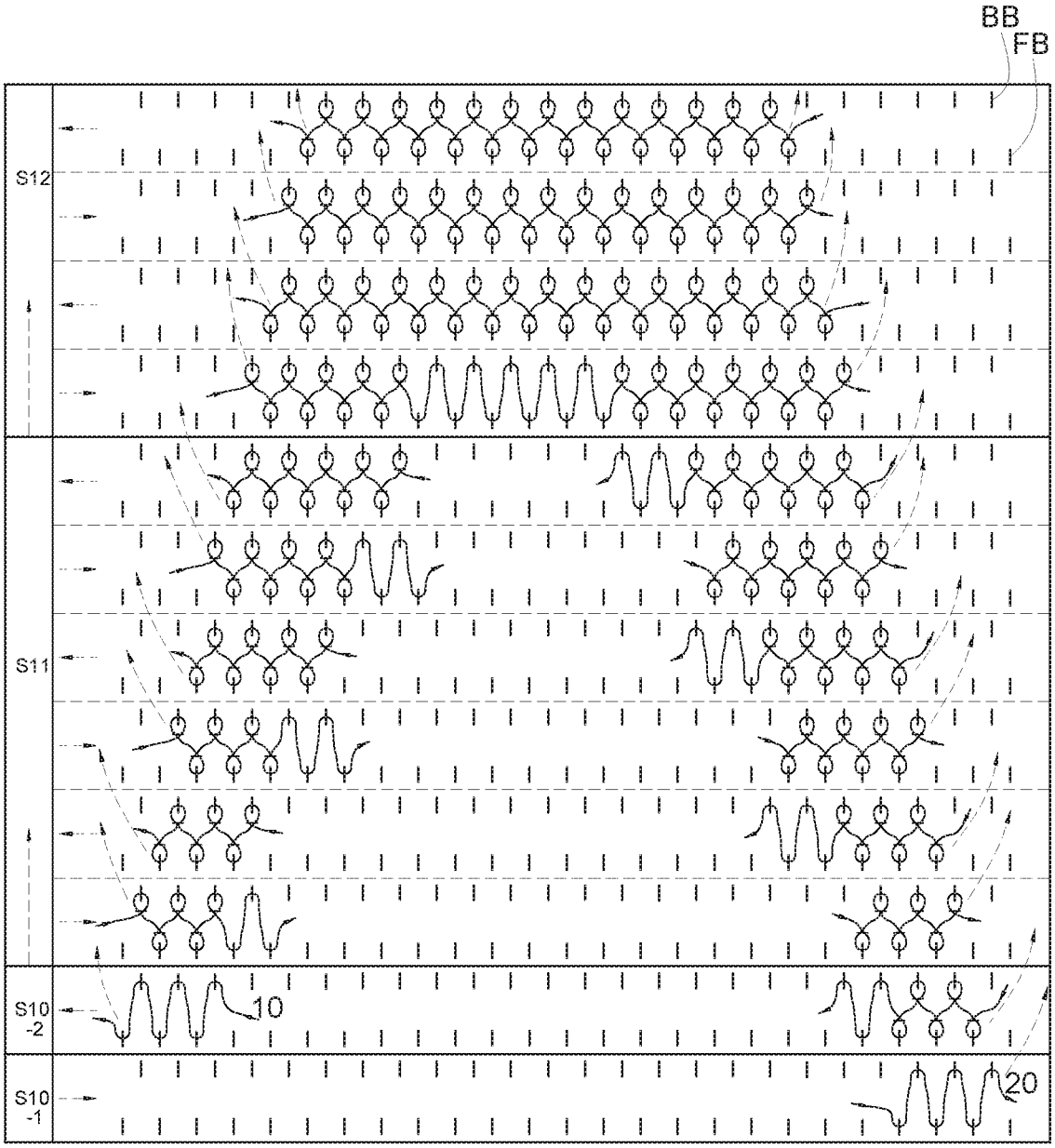
FIG. 12 is a schematic knitting diagram of the upper portion of the 3D shoe blank according to an embodiment of the present invention.

Hereafter, referring to FIGS. 12~13 and FIG. 1 to FIG. 11, the method for knitting the 3D shoe blank 100 or 200 in a double-knitting manner by using a double-bed flat knitting machine is illustrated, but not limited thereto. For example, as shown in FIG. 12, in step 10-1, forward knitting from left to right, a yarn 20 is knitted alternatingly on the right side of a front needle bed FB and a back needle bed BB to form a cast-on line of the second extension portion 214*b* (i.e. one stitch on the front needle bed FB, one stitch on the back needle bed BB, then one stitch on the front needle bed FB, one stitch on the back needle bed BB, and so, on). In step 10-2, reverse knitting from right to left, the yarn 20 is knitted alternatingly on the front needle bed FB and the back needle bed BB to connect the cast-on line of the second upper extension portion 214*b*, wherein the stitches are decreased at the outer side to preserve the outmost stitch on the needle bed (such as the back needle bed BB) and increased to add stitches at the inner side of the second upper extension portion 214*b*. Then, another yarn 10 is knitted alternatingly on the left side of the front needle bed FB and the back needle bed BB to form a cast-on line of the first extension portion 214*a* (i.e. one stitch on the back needle bed BB, one stitch on the front needle bed FB, then one stitch on the back needle bed BB, one stitch on the front needle bed FB, and so, on).

In step 11, knitting from left to right or right to left, the yarns 10 and 20 are knitted alternatingly on the front needle bed FB and the back needle bed BB to form the first upper extension portion 214*a* and the second upper extension portion 214*b*. For example, the yarn 10 is knitted alternatingly on the front needle bed FB and the back needle bed BB to connect the cast-on line of the first upper extension portion 214*a*, wherein the stitches are decreased at the outer side to preserve the outmost stitch on the needle bed (such as the front needle bed FB) and increased to add stitches at the inner side of the first upper extension portion 214*a*. Then, the yarn 20 is knitted to form another course of the second upper extension portion 214*b*, wherein when knitting the second upper extension portion 214*b*, the stitches are decreased at the outer side to preserve the rightmost stitch of the second upper extension portion 214*b* on the front needle bed FB. Reverse knitting from right to left, the yarn 20 is knitted alternatingly on the front needle bed FB and the back needle bed BB to form another course of the second upper extension portion 214*b*, wherein the stitches are decreased at the outer side to preserve the outmost stitch on the back needle bed BB and increased to add stitches at the inner side (i.e. left side) of the second upper extension portion 214*b*. Then, the yarn 10 is knitted to form another course of the first upper extension portion 214*a*, wherein when knitting the first upper extension portion 214*a*, the stitches are decreased at the outer side (i.e. left side) to preserve the leftmost stitch of the first upper extension portion 214*a* on the back needle bed BB. Next, knitting from left to right, the yarn 10 is knitted alternatingly on the front needle bed FB and the back needle bed BB to form the first upper extension portion 214*a*, wherein the stitches are decreased at the left side to preserve the outmost stitch on the back needle bed BB and increased to add stiches at the inner side (i.e. right side) of the first upper extension portion 214*a*. Then, the yarn 20 is knitted to form the second upper extension portion 214*b*, wherein when knitting the second upper extension portion 214*b*, the stitches are decreased at the outer side to preserve the outmost stitch of the second upper extension portion 214*b* on the front needle bed FB. Then, reverse knitting from right to left, the yarn 20 is knitted alternatingly on the front needle bed FB and the back needle bed BB to form the second upper extension portion 214*b*, wherein the stitches are decreased at the outer side to preserve the outmost stitch on the back needle bed BB and increased to add stiches at the inner side (i.e. left side) of the second upper extension portion 214*b*. The yarn 10 is knitted to form the first upper extension portion 214*a*, wherein when knitting the first upper extension portion 214*a*, the stitches are decreased at the outer side (i.e. left side) to preserve the outmost stitch of the first upper extension portion 214*a* on the back needle bed BB. Consequently, by repeating the knitting from left to right and the reverse knitting from right to left, the stitches are gradually decreased at the outer side and increased at the inner side of the first upper extension portion 214*a* up to where the upper portion 212 is to be formed, and a plurality of live stitches (such as 17*a*~14*a*) are preserved on the needle beds at the left side of the first upper extension portion 214*a*. At the same time, the stitches are gradually decreased at the outer side and increased at the inner side of the second upper extension portion 214*b* up to where the upper portion 212 is to be formed, and a plurality of live stitches (such as 17*b*~14*b*) are preserved on the needle beds at the right side of the second upper extension portion 214*b*. It is noted that the number of stitches preserved at the left side or right side varies with the number of the courses of the upper extension portion 214*a* or 214*b*, and it is not limited to the embodiment.

As shown in step S12 of FIG. 12, in an embodiment, the yarn 10 of the first upper extension portion 214*a* and/or the yarn 20 of the second extension portion 214*b* can continue to be knitted to form the upper portion 212, wherein the upper portion 212 and the upper extension portions 214*a* and 214*b* are combined to form the upper assembly 210. For example, knitting from left to right, the yarn 10 of the first upper extension portion 214*a* continues to be knitted to form the upper portion 212, wherein when knitting the upper portion 212, the stitches are decreased at the left side to preserve the leftmost stitch of the upper portion 212 on the front needle bed FB and at the right side to preserve the rightmost stitch of the upper portion 212 on the front needle bed FB, and a plurality of live stitches are preserved on the needle bed at the two sides of the upper portion. Then, reverse knitting from right to left, the yarn 10 is knitted to form a next course of the upper portion 212, wherein when knitting the upper portion 212, the stitches are decreased at the right side to preserve the rightmost stitch of the upper portion 212 on the back needle bed BB and at the right side to preserve the leftmost stitch of the upper portion 212 on the back needle bed BB. Consequently, by repeating the knitting from left to right and the reverse knitting from right to left, the stitches are gradually decreased at the two sides of the upper portion 212, and a plurality of live stitches (such as 11*a*~13*a*) are preserved on the needle beds at the left side of the upper portion 212, while a plurality of live stitches (such as 11*b*~13*b*) are preserved on the needle beds at the right side of the upper portion 212. As such, the knitting of the upper assembly 210 is completed, wherein a plurality of live stitches (such as live stitches 11*a*~13*a*, 11*b*~13*b* of the upper portion 212, live stitches 14*a*~17*a* of the first upper extension portion 214*a*, and live stitches 14*b*~17*b* of the second upper extension portion 214*b*) are preserved on the needle beds at the two sides of the upper assembly 210. It is noted that the number of stitches preserved at the left side or right side of the upper portion 212 varies with the number of the courses of the upper portion 212, and it is not limited to the embodiment. That is, the number of stitches preserved at the left side or right side of the upper assembly 210 varies with the number of the courses of the upper assembly 210.

It is noted that when forming the 3D shoe blank 100 of FIG. 1, at least a yarn (such as 10 and 20) is knitted alternatingly on the front needle bed FB and the back needle bed BB to form a cast-on line of the upper portion 112. Then, the yarn can be knitted according to the step S12 of FIG. 12 to form the upper portion 112, wherein when knitting the upper portion 112, the stitches are gradually decreased at two sides of the upper portion 112, and a plurality of live stitches (such as 11*a*~17*a*, 11*b*~17*b*) are preserved on the front/back needle bed at the two sides of the upper portion 112 as described above, and will not be elaborated again.

The method further includes: continuing knitting and forming a front sole portion (such as 120 and 220) from the upper portion (such as 112, 212), wherein when the knitting of the front sole portion reaches two sides of the front sole portion, the live stitches (such as 11*a*~17*a*, 11*b*~17*b*) preserved on the needle beds (such as front needle bed FB and back needle bed BB) at the two sides of the upper portion are sequentially and respectively knitted with the two sides of the front sole portion, so the upper portion is folded and connected to the front sole portion to form a pocket structure. For example, the front sole portion 120 and 220 can be double-knitted by continuing using the yarns 10 and 20 previously used or another yarn that is additionally introduced from one side of the upper portion 112 opposite to the cast-on line of the upper portion 112 or from one side of the upper portion 212 opposite to the upper extension portions 214*a* and 214*b*. When the knitting of the front sole portion 120/220 reaches the left border of the front sole portion 120/220, the location of the leftmost stitch (such as 21*a*) of the front sole portion 120/220, which is to be knitted, corresponds to the live stitch 11*a* preserved at the left side of the upper portion 112/212. Then, the live stitch 11*a* of the upper portion 112/212 is knitted with the front sole portion 120/220. When the knitting of the front sole portion 120/220 reaches the right border of the front sole portion 120/220, the location of the rightmost stitch (such as 21*b*) of the front sole portion 120/220, which is to be knitted, corresponds to the live stitch 11*ab* preserved at the right side of the upper portion 112/212. Then, the live stitch 11*b* of the upper portion 112/212 is knitted with the front sole portion 120/220. Therefore, when knitting the front sole portion 120/220, the live stitches (such as 11*a*~17*a*, 11*b*~17*b*) of the upper portion 112/212 are sequentially and respectively knitted with the two sides of the front sole portion 120/220 at the locations of stitches 21*a*-27*a*, 21*b*~27*b*. Therefore, when the knitting of the front sole portion 120 is completed, the folding of the upper portion 112 to the front sole portion 120 and the connection of the upper portion 112 to the front sole portion 120 by the connection lines 102 and 103 are also completed to form the pocket structure. Similarly, when the knitting of the front sole portion 220 is completed, the folding of the upper assembly 210 (including the upper portion 212, the upper extension portions 214*a* and 214*b*) to the front sole portion 220 and the connection of the upper assembly 210 to the front sole portion 220 by the connection lines 202 and 203 are also completed to form the pocket structure.

Figure 13:
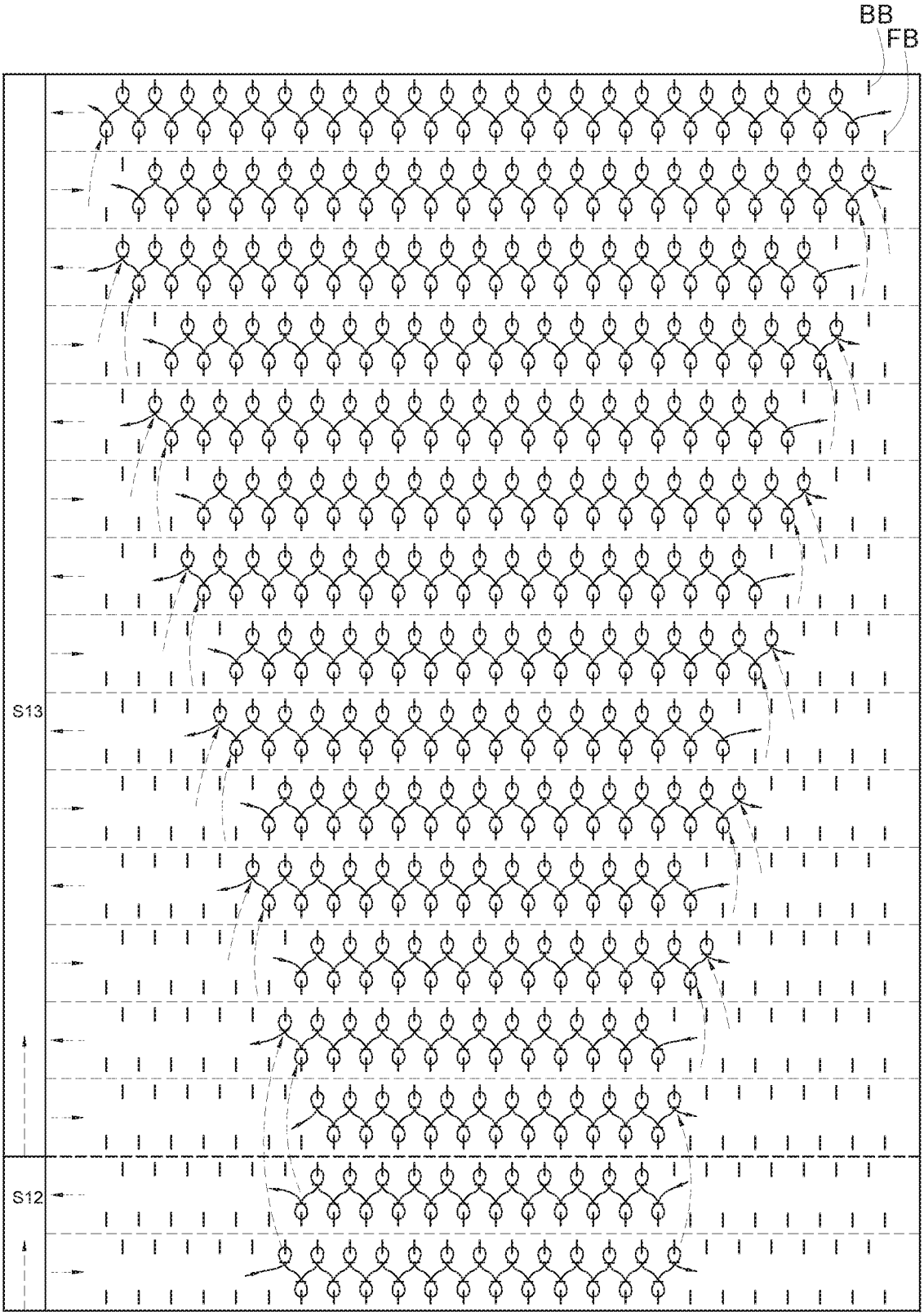
FIG. 13 is a schematic knitting diagram continued to FIG. 12.

For example, the knitting of the front sole portion 220 (or 120) is shown in FIG. 13. In step S13, knitting from left to right, the yarn of the upper portion 212 (or 112) is double-knitted to form the front sole portion 220 (or 120). When the knitting reaches the right border of the front sole portion 220 (or 120), the location of rightmost stitch of the front sole portion 220 (or 120) at the back needle bed BB corresponds to the rightmost live stitch of the upper portion 212 (or 112) preserved on the back needle bed BB. Then, the rightmost live stitch of the upper portion 212 (or 112) preserved on the back needle bed BB can be knitted with the right side of the front sole portion 220. Then, reverse knitting from right to left, when the knitting reaches the left border of the front sole portion 220 (or 120), the location of leftmost stitch of the front sole portion 220 (or 120) at the front needle bed FB corresponds to the leftmost live stitch of the upper portion 212 (or 112) preserved on the front needle bed FB. Then, the leftmost live stitch of the upper portion 212 (or 112) preserved on the front needle bed FB can be knitted with the left side of the front sole portion 220. Moreover, the location of leftmost stitch of the front sole portion 220 (or 120) at the back needle bed BB corresponds to the leftmost live stitch of the upper portion 212 (or 112) preserved on the back needle bed BB. Then, the leftmost live stitch of the upper portion 212 (or 112) preserved on the back needle bed BB can be knitted with the left side of the front sole portion 220. Next, knitting from left to right, when the knitting reaches the right border of the front sole portion 220 (or 120), the location of rightmost stitch of the front sole portion 220 (or 120) at the front needle bed FB corresponds to the rightmost live stitch of the upper portion 212 (or 112) preserved on the front needle bed FB. Then, the rightmost live stitch of the upper portion 212 (or 112) preserved on the front needle bed FB can be knitted with the right side of the front sole portion 220. Moreover, the location of rightmost stitch of the front sole portion 220 (or 120) at the back needle bed BB corresponds to the rightmost live stitch of the upper portion 212 (or 112) preserved on the back needle bed BB. Then, the rightmost live stitch of the upper portion 212 (or 112) preserved on the back needle bed BB can be knitted with the right side of the front sole portion 220 (or 120). Consequently, by repeating the knitting of the front sole portion 220 (or 120) as described above, the live stitches preserved on the needle beds at the left and right sides of the upper assembly 210 (or the upper portion 112) are sequentially and respectively knitted with the two sides of the front sole portion 220 (or 120), so the upper assembly 210 (or the upper portion 112) is folded and connected to the front sole portion 220 (or 120).

The method further includes: continuing knitting and forming a rear portion 120 from the front sole portion 120 (or 220), wherein when forming the rear portion 130, a plurality of live stitches (such as 31*a*~38*a*, 31*b*~38*b*) are preserved on the needle beds at two sides of a rear end of the rear portion 130; and continuing knitting to form a heel portion 140 with a predetermined number of stitches from a center of the rear end of the rear portion 130, wherein when the knitting of the heel portion 140 reaches the predetermined number of stitches at two opposite sides of the heel portion 140, the live stitches (such as 31*a*~38*a*, 31*b*~38*b*) preserved at the two sides of the rear end of the rear portion 130 are sequentially and respectively knitted with the two opposite sides of the heel portion 140, so the heel portion 140 and the rear portion 130 are combined to form a 3D rear shoe portion 100*a*. As described, the rear portion 130 can be knitted from the yarn of the front sole portion (such as yarn 10) or another yarn, or the rear portion 130 can be knitted from the yarn of the front sole portion (such as yarn 10) together with another yarn. In this embodiment, the yarn 10 is double-knitted back and forth from left to right or right to left on the front needle bed FB and the back needle bed BB, so the rear portion 130 is connected to the rear end of the front sole portion 120 (or 220).

The heel portion 140 can be knitted from the yarn of the rear portion 130 (such as yarn 10) or another yarn, or the heel portion is knitted from the yarn of the rear portion 130 (such as yarn 10) together with another yarn. For example, after forming the rear portion 130, the yarn 10 is knitted on the front needle bed FB and the rear needle bed BB from the left side of the rear portion 130 toward the center of the rear portion 130 to form a predetermined number of stitches of the heel portion 140, and a plurality of live stitches (such as 31*a*~38*a*) are preserved on the front needle bed FB at the right side of the rear end of the rear portion 130. It is noted that when the knitting of the heel portion 140 reaches the predetermined number of stitches on the right border, the location of the rightmost stitch 41*a* of the heel portion 140 corresponds to the location of the innermost (i.e. leftmost) live stitch 31*a* of the live stitches 31*a*~38*a* preserved at the right rear end of the rear portion 130. By moving the back needle bed BB transversely, the stitch 31*a* of the rear portion 130 is knitted with the heel portion 140, so the right side of the heel portion 140 is connected to the right rear end of the rear portion 130.

Then, reversing knitting from right to left, the yarn 10 is knitted on the front needle bed FB and the rear needle bed BB from the right border to the left border of the heel portion 140 to form a next course of the heel portion 140, and a plurality of live stitches (such as 31*b*~38*b*) are preserved on the front needle bed FB at the left side of the rear end of the rear portion 130. It is noted that when the knitting of the heel portion 140 reaches the predetermined number of stitches on the left border, the location of the leftmost stitch 41*b* of the heel portion 140, corresponds to the location of the innermost (i.e. rightmost) live stitch 31*b* of the live stitches 31*b*~38*b* preserved at the left rear end of the rear portion 130. By moving the back needle bed BB transversely, the stitch 31*b* of the rear portion 130 is knitted with the heel portion 140, so the left side of the heel portion 140 is connected to the left rear end of the rear portion 130.

The heel portion 140 is repeatedly knitted back and forth from right to left or left to right in a similar manner, wherein when the knitting of the heel portion 140 reaches the predetermined number of stitches at two opposite sides of the heel portion 140, by moving the back needle bed BB transversely, the live stitches (such as 31*a*~38*a*, 31*b*~38*b*) preserved on the front needle bed FB at the right and left rear ends of the rear portion 130 are sequentially and respectively knitted with the right and left sides of the heel portion 140, so the heel portion 140 and the rear portion 130 are combined to form a 3D rear shoe portion 100*a*. For example, the number of the live stitches (such as 31*b*-38*b*) preserved at the left rear end of the rear portion 130 is preferably the same as the number of the live stitches (such as 31*a*~38*a*) preserved at the right rear end of the rear portion 130. Therefore, by repeating the double-knitting of the heel portion 140 on the front needle bed FB and the back needle bed BB as described above, the right live stitch 32*a* of the rear portion 130 is knitted with the heel portion 140 at the location of the stitch 42*a* at the right border, and the left live stitch 32*b* of the rear portion 130 is knitted with the heel portion 140 at the location of the stitch 42*b* at the left border. The right live stitch 33*a* of the rear portion 130 is knitted with the heel portion 140 at the location of the stitch 43*a* at the right border, and the left live stitch 33*b* of the rear portion 130 is knitted with the heel portion 140 at the location of the stitch 43*b* at the left border. The right live stitch 34*a* of the rear portion 130 is knitted with the heel portion 140 at the location of the stitch 44*a* at the right border, and the left live stitch 34*b* of the rear portion 130 is knitted with the heel portion 140 at the location of the stitch 44*b* at the left border. The right live stitch 35*a* of the rear portion 130 is knitted with the heel portion 140 at the location of the stitch 45*a* at the right border, and the left live stitch 35*b* of the rear portion 130 is knitted with the heel portion 140 at the location of the stitch 45*b* at the left border. The right live stitch 36*a* of the rear portion 130 is knitted with the heel portion 140 at the location of the stitch 46*a* at the right border, and the left live stitch 36*b* of the rear portion 130 is knitted with the heel portion 140 at the location of the stitch 46*b* at the left border. The right live stitch 37*a* of the rear portion 130 is knitted with the heel portion 140 at the location of the stitch 47*a* at the right border, and the left live stitch 37*b* of the rear portion 130 is knitted with the heel portion 140 at the location of the stitch 47*b* at the left border. The right live stitch 38*a* of the rear portion 130 is knitted with the heel portion 140 at the location of the stitch 48*a* at the right border, and the left live stitch 38*b* of the rear portion 130 is knitted with the heel portion 140 at the location of the stitch 48*b* at the left border. Consequently, the right border of the heel portion 140 is connected to the right rear end of the rear portion 130, so the joining line 104*a* is formed. The left border of the heel portion 140 is connected to the left rear end of the rear portion 130, so the joining line 104*b* is formed. As such, the heel portion 140 and the rear portion 130 are combined to form the 3D rear shoe portion 100*a*, and the 3D shoe blank 100 (or 200) is completed.

Figure 14:
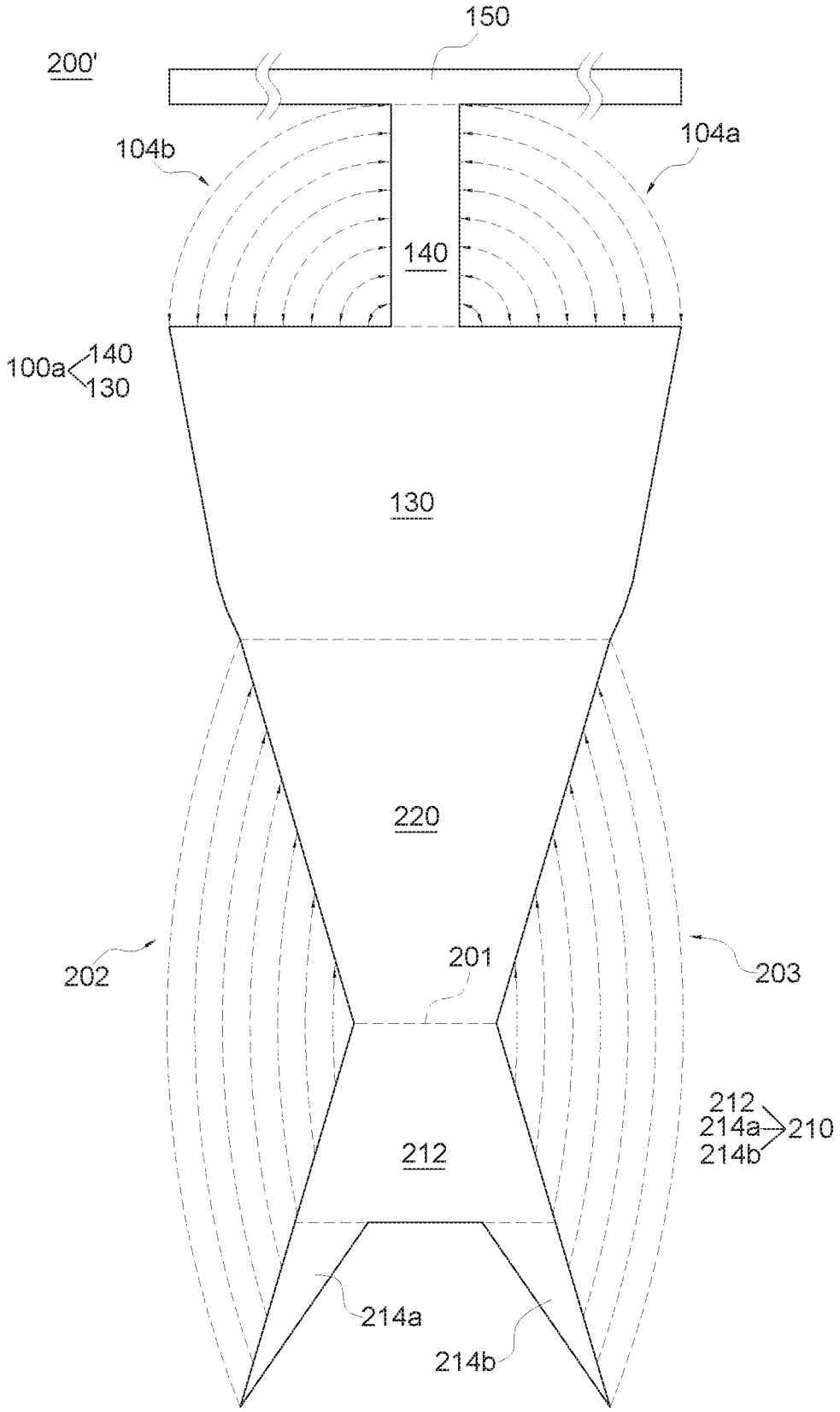
FIG. 14 is a schematic plan view of a third embodiment of the 3D shoe blank.
Figure 15:
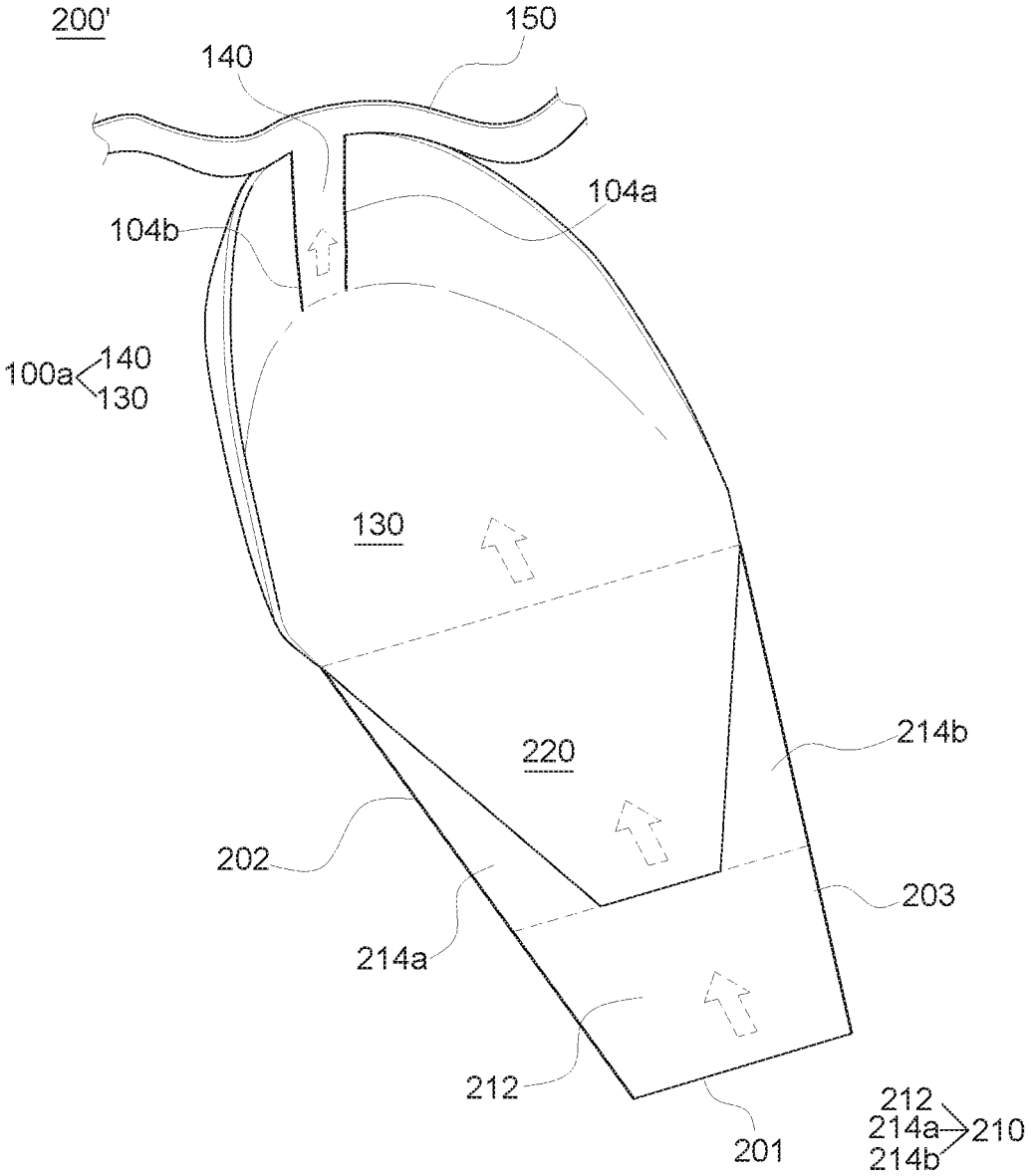
FIG. 15 is a 3D schematic view of the third embodiment of the 3D shoe blank.

Moreover, in addition to the design change in the upper portion, the 3D shoe blank of the invention may have other modifications to achieve different outer appearances or to provide other functions. As shown in FIG. 14 and FIG. 15, in a third embodiment, the 3D shoe blank 200' further includes an extension strap 150, which is partially connected to the heel portion 140 and extends outward toward the two opposite sides of the heel portion 140. In this embodiment, the 3D shoe blank 200' is a modification of the 3D shoe blank 200 of FIG. 6, but the extension strap 150 may be applied to the 3D shoe blank 100 of FIG. 1. The extension strap 150 is preferably a strap knitted from at least a yarn and connected to the heel portion 140. In an embodiment, the extension strap 150 is preferably double-knitted from at least a yarn used in the previously knitting process (such as yarn 10) or another yarn that is additional introduced. In another embodiment, the extension strap 150 can be double-knitted from the yarn used in the previously knitting process (such as yarn 10) together another yarn.

Corresponding to the design of the extension strap 150, the method of the invention further includes: double-knitting on the front needle bed FB and the back needle bed BB to form the extension strap 150, which is partially connected to the heel portion 140 and extends outward toward two opposite sides of the heel portion 140. That is, after the 3D rear shoe portion 100*a* is formed, at least a yarn is provided and knitted to form the extension strap 150, so one side of the extension strap 150 is partially connected to the heel portion 140 and two ends of the extension strap 150 extend outward toward two opposite sides of the heel portion 140. For example, in the case of knitting from right to left to form the heel portion 140, after the left live stitch 38*b* of the rear portion 130 is knitted with left border of the heel portion 140 at the location of the stitch 48*b*, the yarn of the heel portion 140 continues to be knitted leftward for a predetermined number of stitches to form the left strap portion of the extension strap 150. Then, the knitting direction is reversed to form a next course of the left strap portion and to connect the heel portion 140. After connecting the heel portion 140, the knitting is continued rightward for a predetermined number of stitches to form the right strap portion of the extension strap 150. By repeating the knitting process back and forth, the extension strap 150 can be formed.

Figure 16:
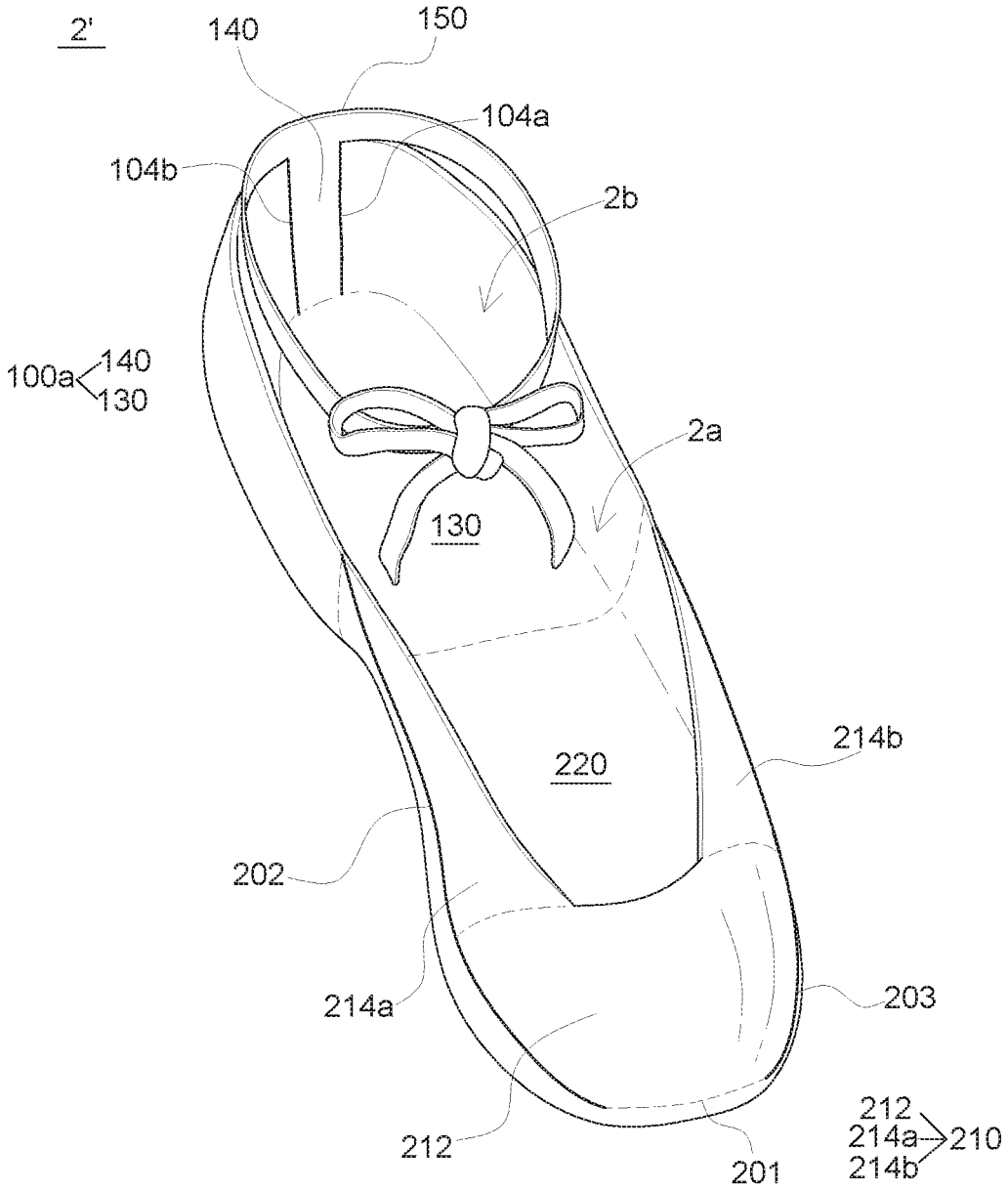
FIG. 16 is a 3D schematic view of a shoe body after the 3D shoe blank of FIG. 15 is molded.

As shown in FIG. 16, after the 3D shoe blank 200' is molded into a shoe body 2', the length of the extension strap 150 is preferably long enough to surround the ankle (indicated by the arrow 2*b*) of the wear's foot and to be fastened to form a bowknot. Therefore, not only the outer appearance of the shoe body 2' can be enhanced, but the function of securing the shoe body 2' is also provided.

Figure 17:
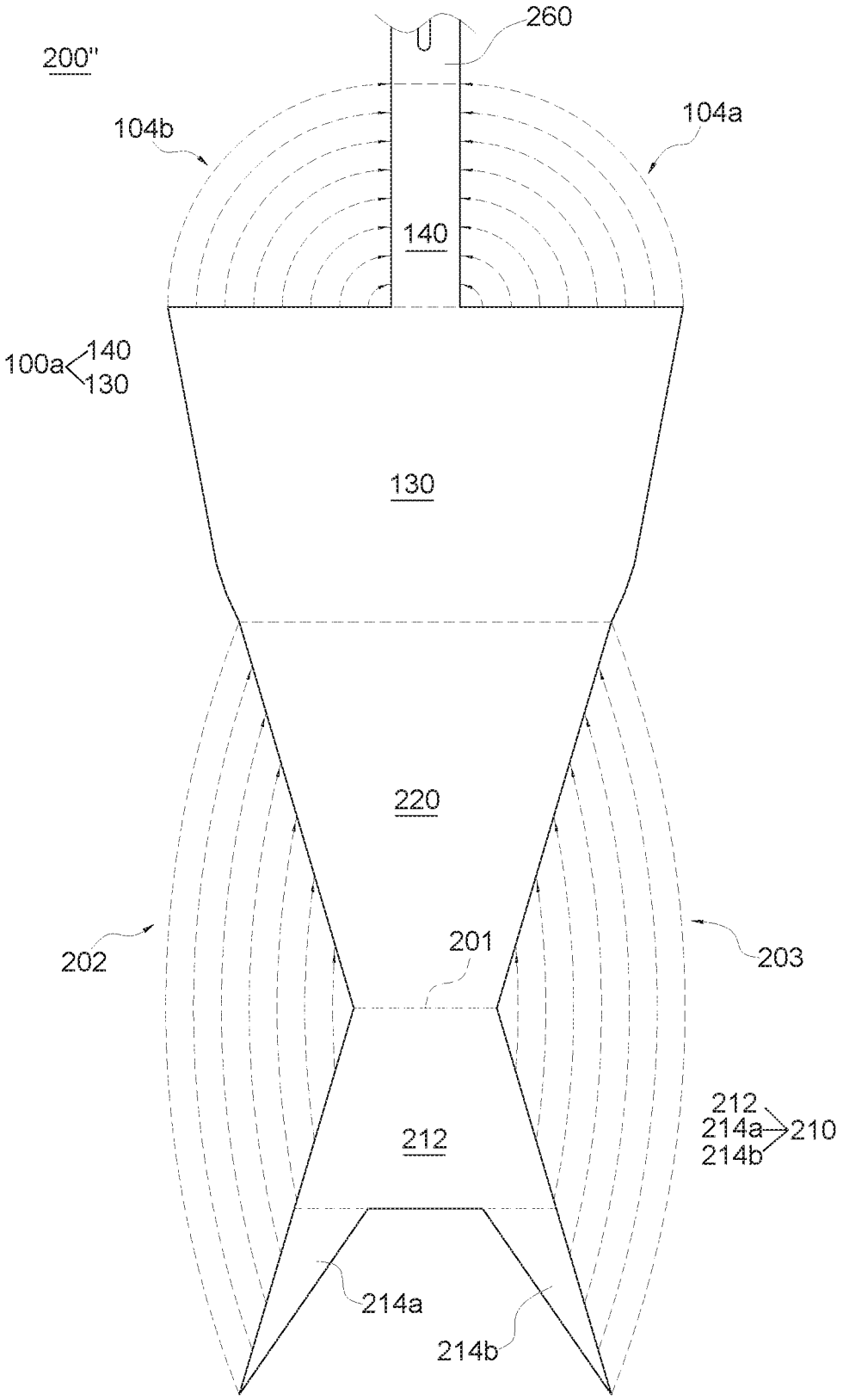
FIG. 17 is a schematic plan view of a fourth embodiment of the 3D shoe blank.
Figure 18:
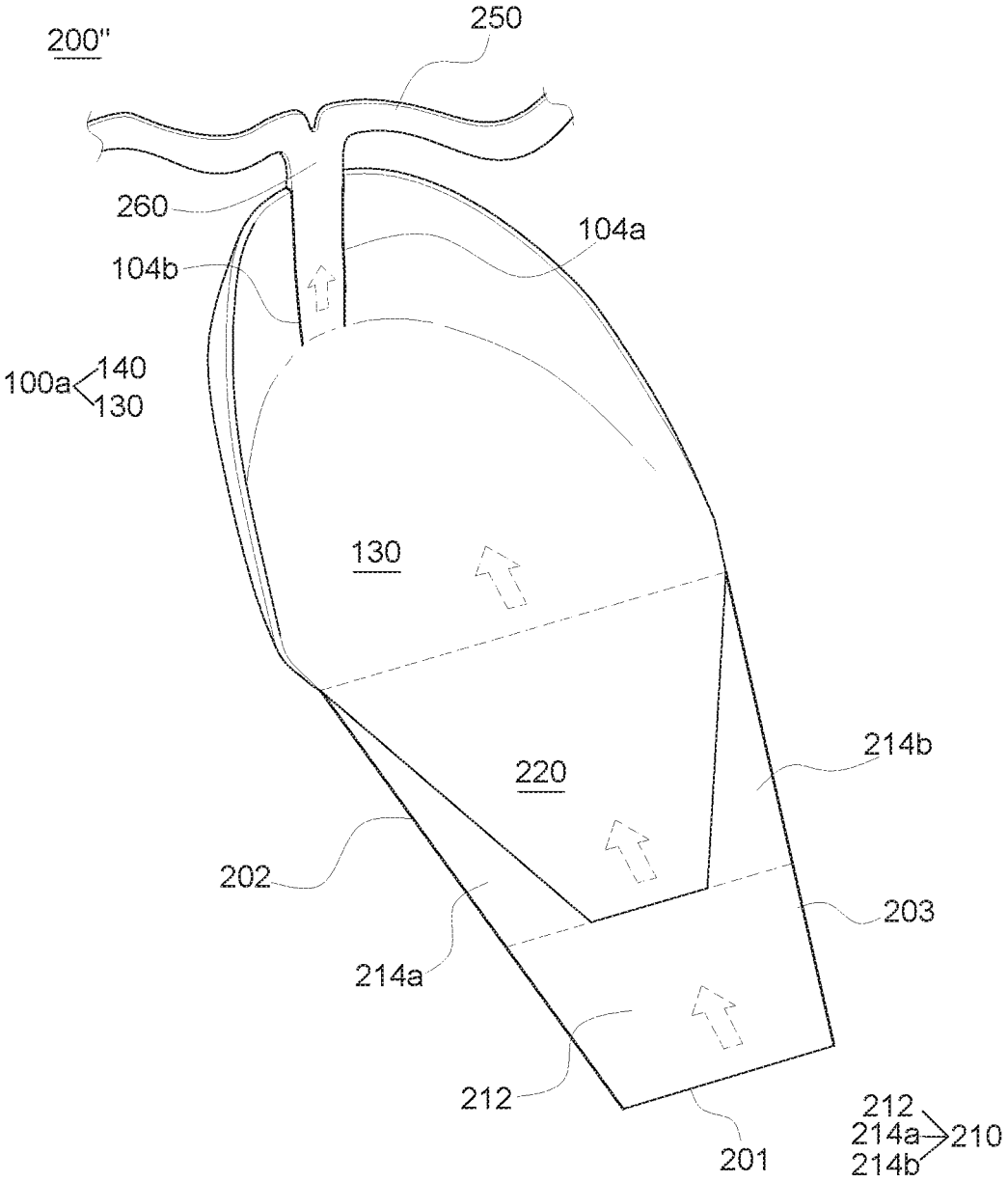
FIG. 18 is a 3D schematic view of the fourth embodiment of the 3D shoe blank.

As shown in FIG. 17 and FIG. 18, in a fourth embodiment, a 3D shoe blank 200" further includes an extension portion 260, which is connected between the heel portion 140 and the extension strap 250. In this embodiment, the 3D shoe blank 200" is a modification of the 3D shoe blank 200 of FIG. 6, but the extension strap 250 and the extension portion 260 may be applied to the 3D shoe blank 100 of FIG. 1. The extension portion 260 extends upward from the upper end of the heel portion 140, so one side of the extension strap 250 is connected to the top side of the extension portion 260 and further connected to the heel portion 140 by means of the extension strap 260. For example, the extension portion 260 and the extension strap 250 are preferably double-knitted from the yarn used in the previously knitting process (such as yarn 10) or another yarn. In another embodiment, the extension portion 260 and the extension strap 250 can be double-knitted from the yarn used in the previously knitting process (such as yarn 10) together with another yarn.

Corresponding to the design of the extension portion 260, the method of the invention further includes: double-knitting from the heel portion 140 on the front needle bed FB and the back needle bed BB to form the extension portion 260 connected between the heel portion 140 and the extension strap 250. In an embodiment, the extension portion 260 is formed by continuing knitting the yarns of the heel portion 140, so the extension portion 260 extends upward from the heel portion 140 and is connected between the heel portion 140 and the extension strap 250. For example, in the case of knitting from right to left to form the heel portion 140, after the left live stitch 38*b* of the rear portion 130 is knitted with left border of the heel portion 140 at the location of the stitch 48*b*, the yarn of the heel portion 140 is reverse-knitted from left to right to connect the heel portion 140 and to form the extension portion 260, and then the knitting process is continued back and forth (i.e. from right to left or left to right) to complete the knitting of the extension portion 250. After the extension portion 260 is formed, the knitting can be continued for example leftward for a predetermined number of stitches to form the left strap portion of the extension strap 250. Then, the knitting direction is reversed to form a next course of the left strap portion and to connect the extension portion 260, and the knitting is continued rightward for a predetermined number of stitches to form the right strap portion of the extension strap 250. By repeating the knitting process back and forth, the extension strap 250 can be formed.

Figure 19:
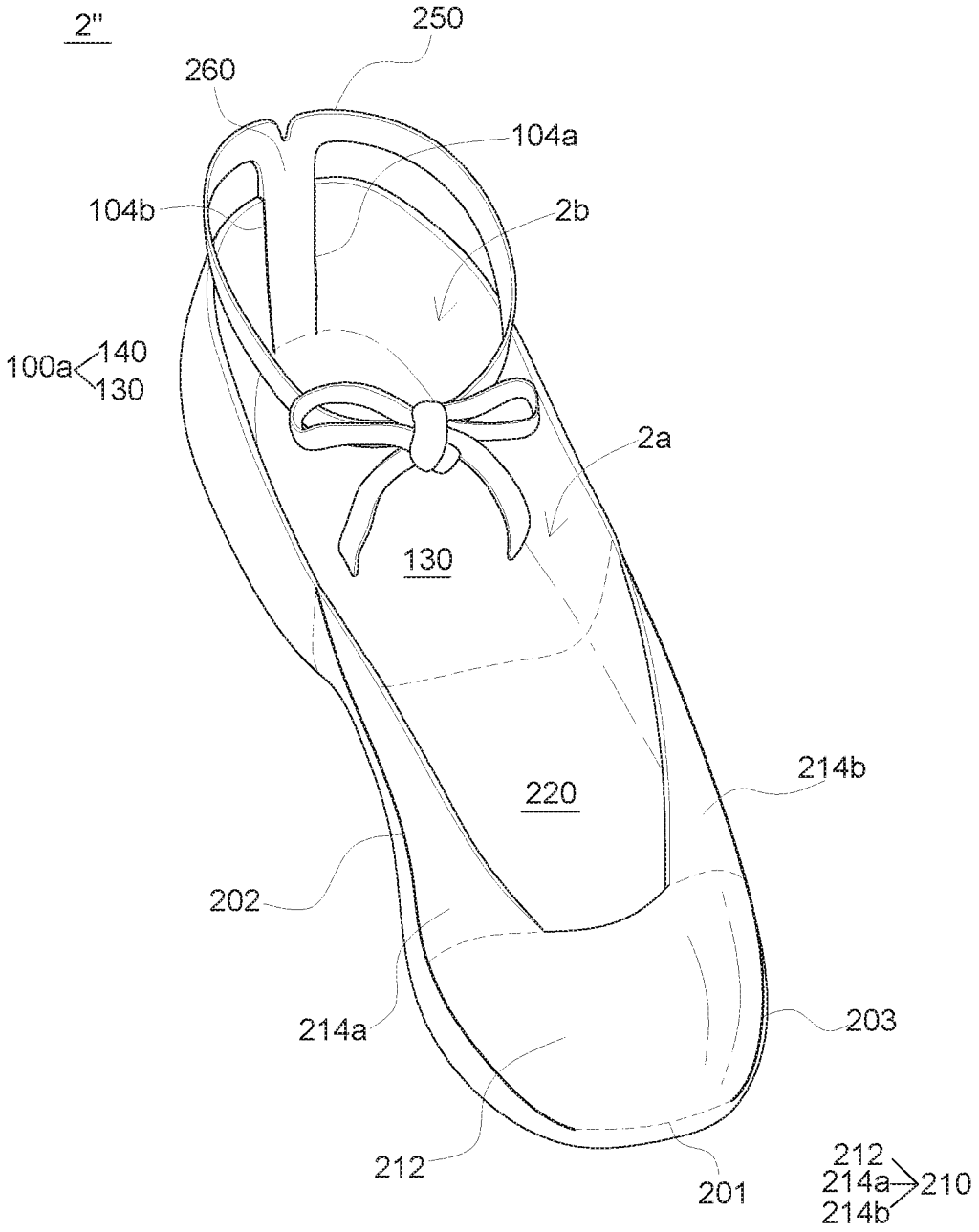
FIG. 19 is a 3D schematic view of a shoe body after the 3D shoe blank of FIG. 18 is molded.

As shown in FIG. 19, after the 3D shoe blank 200" is molded into a shoe body 2", the design of the extension portion 260 can increase the convenience of wearing shoes and maintain a certain distance between the extension strap 250 and the heel portion 140 to vary the outer appearance of the shoe body 2". The length of the extension strap 250 is preferably long enough to surround the ankle (indicated by the arrow 2*b*) of the wear's foot and to be fastened to form a bowknot. Therefore, not only the outer appearance of the shoe body 2" can be enhanced, but the function of securing the shoe body 2" is also provided.

Although the preferred embodiments of the present invention have been described herein, the above description is merely illustrative. The preferred embodiments disclosed will not limit the scope of the present invention. Further modification of the invention herein disclosed will occur to those skilled in the respective arts and all such modifications are deemed to be within the scope of the invention as defined by the appended claims.

What is claimed is:

1. A method for knitting a three-dimensional (3D) shoe blank by using a flat knitting machine, comprising:

knitting at least a yarn to form an upper portion, wherein when knitting the upper portion, the knitting is gradually narrowed at two sides of the upper portion over an entire knitting period of the upper portion, and a plurality of live stitches of the upper portion are preserved on the needle bed at the two sides of the upper portion;

continuing knitting and forming a front sole portion from the upper portion, wherein when knitting the front sole portion reaches two sides of the front sole portion, the live stitches preserved on the needle bed at the two sides of the upper portion are sequentially and respectively knitted with the two sides of the front sole portion, so the upper portion is folded to the front sole portion along a folding line between the front sole portion and the upper portion and connected to the front sole portion by two connection lines formed at two sides of the front sole portion and the upper portion to form a flat pocket structure flatly extending parallel to an extension plane of the upper portion and the front sole portion, and the folding line and the two connection lines outline an outer perimeter of the flat pocket structure when knitting the front sole portion is completed;

continuing knitting and forming a rear portion from the front sole portion, wherein when forming the rear portion, a plurality of live stitches are preserved on the needle bed at two sides of a rear end of the rear portion, wherein the two connection lines continuously extend outward and obliquely from two ends of the folding line to a left outer side and a right outer side of the rear portion, respectively; and continuing knitting to form a heel portion with a predetermined number of stitches from a center of the rear end of the rear portion, wherein when the knitting of the heel portion reaches the predetermined number of stitches at two opposite sides of the heel portion, the live stitches preserved at the two sides of the rear end of the rear portion are sequentially and respectively knitted with the two opposite sides of the heel portion, so the heel portion is in a rectangle shape and combined with the rear portion to form a 3D rear shoe portion when the knitting of the heel portion is completed.

2. The method of claim 1, before forming the upper portion, the method further comprising:

knitting the at least a yarn to form a first upper extension portion, wherein when knitting the first upper extension portion, stitches are gradually decreased at an outer side and increased at an inner side of the first upper extension portion up to where the upper portion is to be formed, and a plurality of live stitches are preserved on the needle bed at the outer side of the first upper extension portion; and knitting at least another yarn to form a second upper extension portion, wherein when knitting the second upper extension portion, stitches are gradually decreased at an outer side and increased at an inner side of the second upper extension portion up to where the upper portion is to be formed, and a plurality of live stitches are preserved on the needle bed at the outer side of the second upper extension portion, and wherein the first upper extension portion and the second upper extension portion are spaced apart and substantially symmetric and together with the upper portion to form an upper assembly.

3. The method of claim 1, wherein the rear portion is knitted from the yarn of the front sole portion or another yarn, or the rear portion is knitted from the yarn of the front sole portion together with another yarn.

4. The method of claim 2, wherein the rear portion is knitted from the yarn of the front sole portion or another yarn, or the rear portion is knitted from the yarn of the front sole portion together with another yarn.

5. The method of claim 1, wherein the heel portion is knitted from the yarn of the rear portion or another yarn, or the heel portion is knitted from the yarn of the rear portion together with another yarn.

6. The method of claim 2, wherein the heel portion is knitted from the yarn of the rear portion or another yarn, or the heel portion is knitted from the yarn of the rear portion together with another yarn.

7. The method of claim 3, wherein the heel portion is knitted from the yarn of the rear portion or another yarn, or the heel portion is knitted from the yarn of the rear portion together with another yarn.

8. The method of claim 4, wherein the heel portion is knitted from the yarn of the rear portion or another yarn, or the heel portion is knitted from the yarn of the rear portion together with another yarn.

9. The method of claim 1, further comprising:

after the 3D rear shoe portion is formed, knitting and forming an extension strap, wherein the extension strap is partially connected to the heel portion and extends outward toward the two opposite sides of the heel portion.

10. The method of claim 9, further comprising:

knitting from the heel portion to form an extension portion connected between the heel portion and the extension strap, so the extension strap is partially connected to the heel portion by means of the extension portion.

11. The method of claim 2, further comprising:

after the 3D rear shoe portion is formed, knitting and forming an extension strap, wherein the extension strap is partially connected to the heel portion and extends outward toward the two opposite sides of the heel portion.

12. The method of claim 11, further comprising:

knitting from the heel portion to form an extension portion connected between the heel portion and the extension strap, so the extension strap is partially connected to the heel portion by means of the extension portion.

* * * * *